US005823150A

United States Patent [19]

Konakawa

[11] Patent Number: 5,823,150

[45] Date of Patent: Oct. 20, 1998

[54] INDUCTION SYSTEM FOR TWO CYCLE ENGINE

[75] Inventor: Tsugunori Konakawa, Iwata, Japan

[73] Assignee: Yamaha Hatsudoki Kabushiki Kaisha, Iwata, Japan

[21] Appl. No.: 200,932

[22] Filed: Feb. 22, 1994

Related U.S. Application Data

[63] Continuation of Ser. No. 994,931, Dec. 22, 1992, abandoned.

[30] Foreign Application Priority Data

| | | | |
|---|---|---|---|
| Dec. 27, 1991 | [JP] | Japan | 3-359229 |
| Dec. 27, 1991 | [JP] | Japan | 3-359230 |
| Dec. 27, 1991 | [JP] | Japan | 3-359231 |
| Dec. 27, 1991 | [JP] | Japan | 3-359232 |
| Jan. 14, 1992 | [JP] | Japan | 4-024723 |

[51] Int. Cl.[6] ..... F02B 33/04

[52] U.S. Cl. ..... 123/73 V; 123/578; 123/584; 123/73 A

[58] Field of Search ..... 123/65 V, 73 A, 123/73 V, 578, 584; 137/512.15, 855

[56] References Cited

U.S. PATENT DOCUMENTS

| | | | |
|---|---|---|---|
| 3,008,459 | 11/1961 | Kaufman | 123/73 R |
| 4,395,978 | 8/1983 | Boyesen | 123/73 R |
| 4,905,638 | 3/1990 | Curtis et al. | 123/73 V |
| 4,928,636 | 5/1990 | Weed | 123/73 V |
| 5,140,964 | 8/1992 | Torigai | 123/73 A |

FOREIGN PATENT DOCUMENTS

| | | |
|---|---|---|
| 0337520 | 10/1989 | European Pat. Off. . |
| 2-40079 | 2/1990 | Japan . |
| 2-45647 | 2/1990 | Japan . |
| 2-61321 | 3/1990 | Japan . |
| 3-286138 | 12/1991 | Japan . |
| 3-286139 | 12/1991 | Japan . |

OTHER PUBLICATIONS

Patent abstracts of Japan vol. 16, No. 119 (M–1225) 25 Mar. 1992 & JP–A–32 86 139 (Suzuki) 17 Dec. 1991.

European Searh Report—EP 92 12 2063 dated Mar. 25, 1993.

*Primary Examiner*—Noah P. Kamen

*Attorney, Agent, or Firm*—Knobbe, Martens, Olson & Bear LLP

[57] ABSTRACT

A number of embodiments of induction system arrangements for a two cycle crankcase compression internal combustion engine having reed valve assemblies comprised of a mounting portion that defines a flow passage and a first caging member that divides the flow passage into first and second sections. A second caging member is affixed to the first caging member and the means which affixes it also affix a first reed valve for valving a valved opening in the first caging member. The valved openings in the caging members are generally rectangular in configuration and have a cross-sectional flow area approximately equal to the cross-sectional flow area of the intake passage in which the reed valve assembly is positioned. At least a pair of generally circular induction passages serve each reed valve member and a variety of different types of throttle valve arrangements and injection patterns are disclosed.

100 Claims, 40 Drawing Sheets

INDUCTION SYSTEM FOR TWO CYCLE ENGINE

This application is a continuation of application Ser. No. 07/994,931, filed Dec. 22, 1992, now abandoned.

BACKGROUND OF THE INVENTION

This invention relates to an improved induction system for a two cycle engine and more particularly to an improved induction system and reed type valve system for a crankcase compression, two cycle internal combustion engine.

The advantages of two cycle crankcase compression internal combustion engines as providing a high power output for a given displacement and as providing relatively compact simple engines are well known. One factor limits, however, the maximum power output that can be generated by such an engine. It is the normal practice to employ a check valve, normally one of the reed valve type, in the induction passage that supplies the intake charge to the crankcase chambers of the engine. This reed type check valve permits the air to flow into the crankcase chamber when the piston is moving upwardly but prevents reverse flow when the piston moves downwardly. If such reverse flow were not precluded, portions of the compressed charge would be driven back through the induction system so as to decrease the volumetric efficiency of the engine. In addition, the reverse flow through the induction passage will adversely affect the next intake cycle.

It has, therefore, been the practice to provide such check valves in two cycle crankcase compression internal combustion engines. However, in order to assist in ease of opening the check valves, they are made quite light in weight and relatively flexible. However, this lightweight, resilient construction can give rise to sealing problems when the charge is being compressed in the crankcase chamber.

As a further disadvantage, the intake passages generally have round cross-sectional configurations while the flow passages of the reed type check valves are generally rectangular in order to provide the desired cross-sectional flow area. As a result of this construction, however, the flow areas of the reed type check valves and the induction passage can be dissimilar and this can give rise to obvious disadvantages in induction efficiency. Even if the same cross-sectional area is provided, the difference in flow shapes may give rise to problems in induction efficiency.

As a further problem with the use of reed type check valves, the check valve is generally comprised of three separate components, which must be fixed together. These components comprise a caging member which extends across the intake passage and which has a flow opening in it. A reed type valve is mounted to this caging member and controls the flow through the flow opening. In addition, a stopper plate is generally employed which cooperates with the reed type check valve so as to limit its degree of maximum opening.

If it is desired to provide better reed type check valve operation, it is preferable to use plural valves rather than a single large valve, for reasons similar to those employed with reciprocating engines and using multiple poppet valves rather than a single large poppet valve. However, with the type of construction described for reed type check valves, the placement of the fasteners for such multiple valves can provide certain disadvantages. That is, a fastener must be employed for fixing the stopper plate and the reed type valve to the caging member and also for securing the caging member to the induction passage. These fasteners can reduce or interfere with the number of reed type check valves that can be employed in a single induction passage.

It is, therefore, a principal object of this invention to provide an improved induction system for a two cycle, crankcase compression internal combustion engine.

It is a further object of this invention to provide an improved induction system for a two cycle, crankcase compression engine that permits the use of multiple reed type valves in a given intake passage without adversely affecting the flow area and while maintaining good efficiency of check valve operation.

It is a further object of this invention to provide an improved, simplified and low cost multiple type check valve arrangement of the reed type valve for a two cycle engine.

It is a further object of this invention to provide an improved and simplified construction for a multiple reed type of check valve for the single induction passage of a two cycle, crankcase compression engine.

In conjunction with two cycle engines, if the intake charge delivered to the crankcase chambers also contains fuel, it is difficult to obtain stratification in the combustion chamber. As is well known, stratification permits operation on a so-called "lean burn" principle wherein the entire chamber need not be charged with a stoichiometric mixture at low and mid range performance. The inability to stratify the charge in a two cycle crankcase compression engine is, therefore, a distinct disadvantage.

It is a further object of this invention to provide an improved induction system for a two cycle, crankcase compression engine wherein fuel stratification can be achieved even if the fuel is introduced into the crankcase chambers.

It is a further object of this invention to provide a multiple induction system for a single crankcase chamber of a two cycle, crankcase compression internal combustion engine that facilitates fuel stratification.

Even if stratification is not desired, there are some advantages in providing better throttle control for the intake passages of a two cycle, crankcase compression engine. That is, although large induction passages are desirable for maximum power output, such large induction passages can be disadvantageous when operating at low and mid range performance.

It is, therefore, a still further object of this invention to provide a staged induction system for a two cycle crankcase compression engine.

As noted above, the use of a relatively large intake passage provides adequate air flow for high performance running but can produce inadequate turbulence, particularly in the crankcase chamber of a two cycle engine, under low running speeds. Turbulence is desirable in the crankcase chamber so as to ensure good mixing of the fuel/air charge and by employing a staged induction system, it is possible to obtain the advantages of a small induction passage at low speeds and a large induction passage at high speeds while at the same time maintaining good volumetric efficiency.

It is, therefore, a still further object of this invention to provide a staged induction system for a two cycle, crankcase compression engine which will generate turbulence and promote mixing in the crankcase chamber.

As has been noted, reed type check valves include a caging member on which the reed valve elements are supported and which defines the flow opening or flow openings which are valved by the reed type valve element. As a result of this construction, the caging member itself protrudes into and obstructs the flow passage to the crankcase. However, in accordance with a further object of this invention, the caging member is configured so as to extend into the induction passage and form a rectifier plate therein for separating and directing the air flow into the crankcase chambers.

SUMMARY OF THE INVENTION

A first feature of this invention is adapted to be embodied in a reed type valve arrangement for a reciprocating machine having a passage serving a variable volume chamber of the machine. A mounting plate is adapted to be affixed within the passage and has a flow passage that extends therethrough. A first caging member is formed integrally with the mounting plate and divides the flow passage into a first portion terminating in a first valved opening and a second portion. A second caging member is affixed to the first caging member and in registry with the second portion of the flow passage. The second caging member forms a second valved opening in communication with the second portion of the flow passage. At least one of the caging members defines a third valved opening communicating with the respective portion of the flow passage. Means are provided for affixing the first, second and third reed valves across the first, second and third valved openings, respectively, for controlling the flow therethrough.

Another feature of the invention is also adapted to be embodied in a reed valve arrangement for a reciprocating machine comprising a caging member defining a passage opening and at least a pair of angular related portions each defining at least one generally rectangular valved opening communicating with the passage opening. The valved openings communicate with a common variable volume chamber of the machine. Reed valve means are provided for controlling the flow through the valved openings.

A pair of generally circular cross-sectional flow passages communicate with the passage opening of the caging member.

DETAILED DESCRIPTION OF THE PREFERRED EMBODIMENTS OF THE INVENTION

Figure 1:
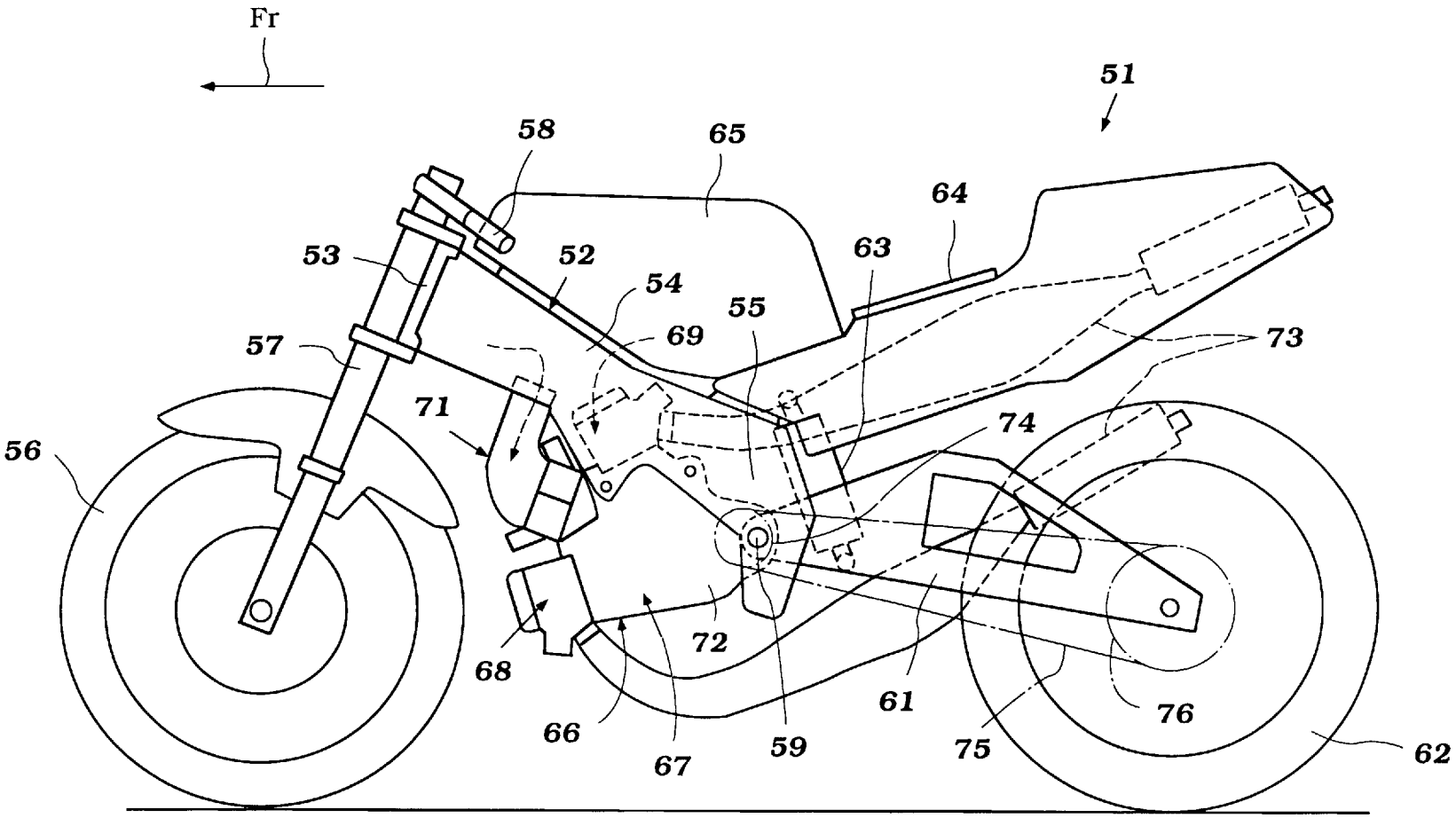
FIG. 1 is a side elevational view of a motorcycle powered by an internal combustion engine constructed in accordance with an embodiment of the invention.

Referring now in detail to the drawings and initially to FIG. 1, a motorcycle powered by an internal combustion engine constructed in accordance with an embodiment of the invention is identified generally by the reference numeral 51. It is to be understood that the description of the motorcycle 51 is intended primarily for orientation purposes and the invention can be applied in conjunction with other forms of uses for internal combustion engines. However, since the invention relates primarily to an induction system for a two cycle, crankcase compression engine and such engines are commonly employed with motorcycles, the motorcycle 51 is described as a typical environment in which the invention may be practiced.

The motorcycle 51 is comprised of a frame assembly, indicated generally by the reference numeral 52, which is comprised of a head pipe 53 and a pair of main frame members 54 which extend rearwardly from the head pipe 53 and which terminate in a rear suspension carrier 55.

A front wheel 56 is dirigibly supported by the head pipe 53 by means including a front fork 57. A handlebar assembly 58 is fixed to the upper end of the front fork 57 for steering of the front wheel 56 in a well known manner.

The rear suspension carrier 55 has a pivot pin 59 that provides a pivotal support for a front end of a trailing arm 61. The rear end of the trailing arm 61 rotatably journals a rear wheel 62 in a known manner. The rear wheel 62 is driven in a manner which will be described. A suspension element 63 is loaded between the trailing arm 61 and the frame assembly 52 for cushioning the movement of the rear wheel 62 relative to the frame 52.

A seat 64 is mounted on the rear portion of the frame 52 and behind a fuel tank 65 for accommodating the rider.

The rear wheel 62 is driven by an internal combustion engine, indicated generally by the reference numeral 66, and having a construction as will be described. The engine 66 is, in the illustrated embodiment, of the V-4 type and which operates on a two cycle, crankcase compression principle. It is to be understood, however, that the invention may be employed in conjunction with engines having other cylinder numbers or other configurations. In fact, the invention may be employed with other reciprocating machines than internal combustion engines which reciprocating machines use ported reed valved passageways. The invention, however, has particular utility in conjunction with two cycle, crankcase compression internal combustion engines.

The engine 66 is comprised of a crankcase 67 having affixed to it a pair of cylinder blocks which with the crankcase 67 forms a pair of cylinder banks 68 and 69 to which cylinder heads are affixed in a known manner. The cylinder banks 68 and 69 and cylinder heads are disposed at a V angle to each other with the cylinder bank 68 being positioned at an acute angle below a horizontal plane and the cylinder bank 69 being disposed at an acute angle to a vertical plane. An induction system, indicated generally by the reference numeral 71, is positioned between the cylinder banks 68 and 69 for admitting a charge to a crankcase, formed by the crankcase 67 and a further crankcase member 72 affixed thereto, in a manner which will be described.

The exhaust from the cylinder banks 68 and 69 is discharged to the atmosphere through exhaust systems 73, one of which passes below the engine 66 while the other of which passes above the engine 66 as clearly shown in FIG. 1.

As is typical with motorcycle practice, the crankcase 67 also contains a change speed transmission which drives a sprocket 74. The sprocket 74, in turn, drives a chain 75 which, in turn, drives a sprocket 76 fixed for rotation with the rear wheel 62 for driving the rear wheel 62 in a well known manner.

The construction of the engine 66 will be described in more derail now by particular reference to FIG. 2, which is a cross-sectional view taken through a single cylinder of the cylinder bank 68. It should be readily apparent to those skilled in the art how the invention is applied to the remaining cylinders of the engine.

As has been noted, the crankcase assembly 67 has affixed to it cylinder blocks 77 and 78, the latter being shown only partially, by means of threaded fasteners 79. Each cylinder block 77 and 78 is formed with a pair of respective cylinder bores 81 each having a respective axis 82. Pistons 83 are reciprocally supported in the cylinder bores 81 and are connected by means of piston pins 84 to the small ends of respective connecting rods 85. The connecting rods 85 are journaled on a crankshaft 86 in a known manner. The crankshaft 86 rotates in a crankcase chamber 87 formed by the crankcase 67 and crankcase member 72 and with each crankcase chamber 87 associated with each cylinder bore 81 being sealed from each other, as is well known with two cycle, crankcase compression engine practice.

A cylinder head 88 is affixed to each cylinder block 77 and 78 and a spark plug 89 is mounted in each cylinder head 88 for each cylinder bore 81. The spark plugs 89 are fired in any known manner.

In accordance with the illustrated embodiment, the engine 66 is water cooled and to this end there are provided cooling jackets 91 in the cylinder blocks 77 and 78 and their respective cylinder heads 88. Coolant is circulated through these cooling jackets 91 in a well known manner.

Each of the cylinder blocks 77 and 78 is provided with one or more exhaust ports 92 which communicate with exhaust passages 93 that extend from the cylinder bores 81 through the cylinder blacks 77 and 78 and communicate with the exhaust system 73 in a well known manner. The direction of flow of the exhaust gases is indicated by the arrow 94 in FIG. 2.

As has been noted, an induction system 71 is provided for delivering a charge to the individual crankcase chambers 87 associated with each cylinder bore 81. This induction system will now be described, initially by reference to FIGS. 2 and 3, and comprises a plurality of intake manifolds 95, one for each cylinder bore 81. Although the invention is described in conjunction with an arrangement wherein there is a separate intake manifold 95 for each cylinder bore 81, a single piece manifold may be employed for all four cylinders or one manifold may be provided for each pair of cylinders. However, there is an advantage to employing individual manifolds 95 for each cylinder. As may be best seen in FIG. 3, the individual manifolds 95 are offset from each other both transversely and axially due to the staggering of the cylinder bores 81 of the respective cylinder banks 68 and 69. The manifolds 95 associated with the cylinder bank 68 are identified by the reference numeral 96 while those associated with the cylinder bank 69 are identified by the reference numeral 97. Except for one feature, which will be described, the manifolds 96 and 97 are substantially the same. Each manifold 95 is affixed to the respective portion of the crankcase 67 by means of socket headed screws 98.

The manifolds 95 are formed with induction passages 99 that are comprised of a pair of parallel passages 101 and 102 which are separated by a dividing wall 103. The wall 103 has a cutout 104 formed at its lower end so that the passages 101 and 102 can communicate with each other at their lower ends and for another purpose, which will be described. An electronically operated fuel injector, indicated generally by the reference numeral 104, is mounted in each manifold 95 and has its spray axis disposed so as to register with a passageway in the manifolds 95 that registers with the cutout 100 in the wall 103 so that fuel will flow into the outlet ends of passages 101 and 102.

A throttle valve assembly, indicated generally by the reference numeral 105, is mounted in a generally oval portion 106 of the manifolds 95 and is comprised of a throttle valve shaft 107 to which butterfly type throttle valves 108 are affixed. The throttle valve assemblies 105 associated with each of the manifolds 95 are operated in unison by a suitable throttle control mechanism. As will be described in connection with the later embodiments, it is also possible to operate the individual throttle valves 108 in a sequential operation so as to provide a form of stratification or to improve turbulence and mixing.

The downstream ends of the intake passages 101 and 102 communicate with a common intake port 109 formed in the crankcase assembly 67 which communicates with the crankcase chambers 87. There are provided a plurality of transfer or scavenge passages that terminate in respective scavenge ports 111 formed in the cylinder blocks 77 and 78 as may be seen in FIG. 2. In addition, there is a direct scavenge passage 112 which communicates directly with the crankcase intake port 109 so as to provide a direct charge into the combustion chambers when the pistons 83 move downwardly as to the position shown in FIG. 2.

A reed type check valve assembly, indicated generally by the reference numeral 113, is disposed between each intake manifold 95 and the respective crankcase portion 67 surrounding its intake port 109. The reed type check valve assemblies 113 are constructed in accordance with an embodiment of the invention and their construction will be described by particular reference to FIGS. 2 and 4–6. Each reed type check valve assembly 113 includes a mounting plate 114 that has a flange portion 115 that is adapted to be sandwiched between the crankcase 67 and the manifold 95 and affixed in place in a manner to be described. The mounting plate 114 is formed with a pair of flow openings 116 and 117 which are divided by a dividing wall 118 that extends into the recess 100 of the dividing wall 103. Air flow which enters the intake passages 101 and 102 in the direction of the arrow 119 in FIG. 2, are divided by the wall 118 into a pair of respective flow streams 121 and 122 passing through the passageways 116 and 117 respectively. The wall 118, because of its extent up to the proximity with the dividing wall 103, is configured so as to function as a rectifier plate to direct the air flow of the streams 121 and 122 in the desired direction into the crankcase chambers 87, as will become apparent.

A first caging member, indicated generally by the reference numeral 123 is formed integrally with the mounting plate 114 and surrounds the passageway 116. The caging member 123 is defined by a pair of intersecting walls 124 and 125 which meet at an apex portion 126. A first series of four generally rectangular valved openings 127 are formed in the wall 124 and a like series of our generally rectangular shaped valved openings 128 are formed in side-by-side fashion in the wall 125. A first reed type valve element, indicated generally by the reference numeral 129, is affixed across the surface 124 and has four individual leaves each of which valves a respective one of the openings 127. A retainer plate 131 and fastening screws 132 serve the purpose of securing the first reed type valve element 129 in position. It should be noted that the intake passage 109 of the crankcase member 67 is formed with a curved surface 133 (FIG. 2) which acts as a stopper plate for the reed type valve element 129.

A second caging member, indicated generally by the reference numeral 134, is formed with a flange portion 135 which is mounted in engaging fashion with the flange portion 115 of the mounting plate 114. If desired, a sealing gasket 136 may be positioned between the flanges 115 and 135. The flange 135 is provided with a first opening 137 that registers with the flange opening 117 and a second larger opening 138 that is sized so as to pass the first caging member 132 with an adequate clearance, as may be clearly shown in FIG. 2. The second caging member 134 has a caging portion 139 which has a passageway 141 which communicates with the opening 137 and which terminates in three valved openings 142 which face in the same direction as the valved openings 128 of the caging member 123.

A second reed type valve element 143 has four finger portions that cooperate with the valved openings 128 in the first caging member surface 124 to control the flow therethrough. This reed type valve element 143 is held in place by means of threaded fasteners 144 that are threaded into tapped openings 145 formed in the first caging member surface 124 and which are engaged in countersunk holes 146 formed in the second caging member 139 so as to assist in securing the second caging member 134 to the first caging member 123. An enlarged opening 148 is formed in the second caging member 134 so as to pass the fasteners 144. The back surface of the second caging member portion 139 is formed with an arcuate surface 149 so as to act as a stopper for the reed type valve element 143.

A third reed type valve element 151 has three finger portions which valve the valve openings 142. This reed valve element 151 is affixed to the second caging member portion 139 by threaded fasteners 152 and a retainer plate 153. The threaded fasteners 152 are received in tapped openings 154 formed in the caging member 134. The flat portion of the third reed valve element 151 closes the openings 148 and precludes any leakage through them.

It should be noted that the second caging member 134 has a length l that is less than the length L of the first caging member 123. The staggering of the width permits the various fasteners 152, 144 and 132 to be placed in position without interfering with each other and thus permits a compact assembly. The reed valve assembly 113 is further fixed in its sandwiching position between the intake manifold 75 and the crankcase 67 by further threaded fasteners 155.

The upper portion of the intake passage 142 is formed with a curved surface 156 so as to function as the stopper plate for the third reed type valve element 151. As a result of the afore described construction, it should be readily apparent that the described construction permits a very compact reed type valve assembly which reduces the number of parts and which furthermore permits a large valving area and a valving area which corresponds to the cross-sectional area of the intake passages 101 and 102 so as to offer no significant flow resistance. In addition, the multiple valve reed type elements permit light weight and rapid operation while, at the same time, assuring good sealing.

Figure 2:
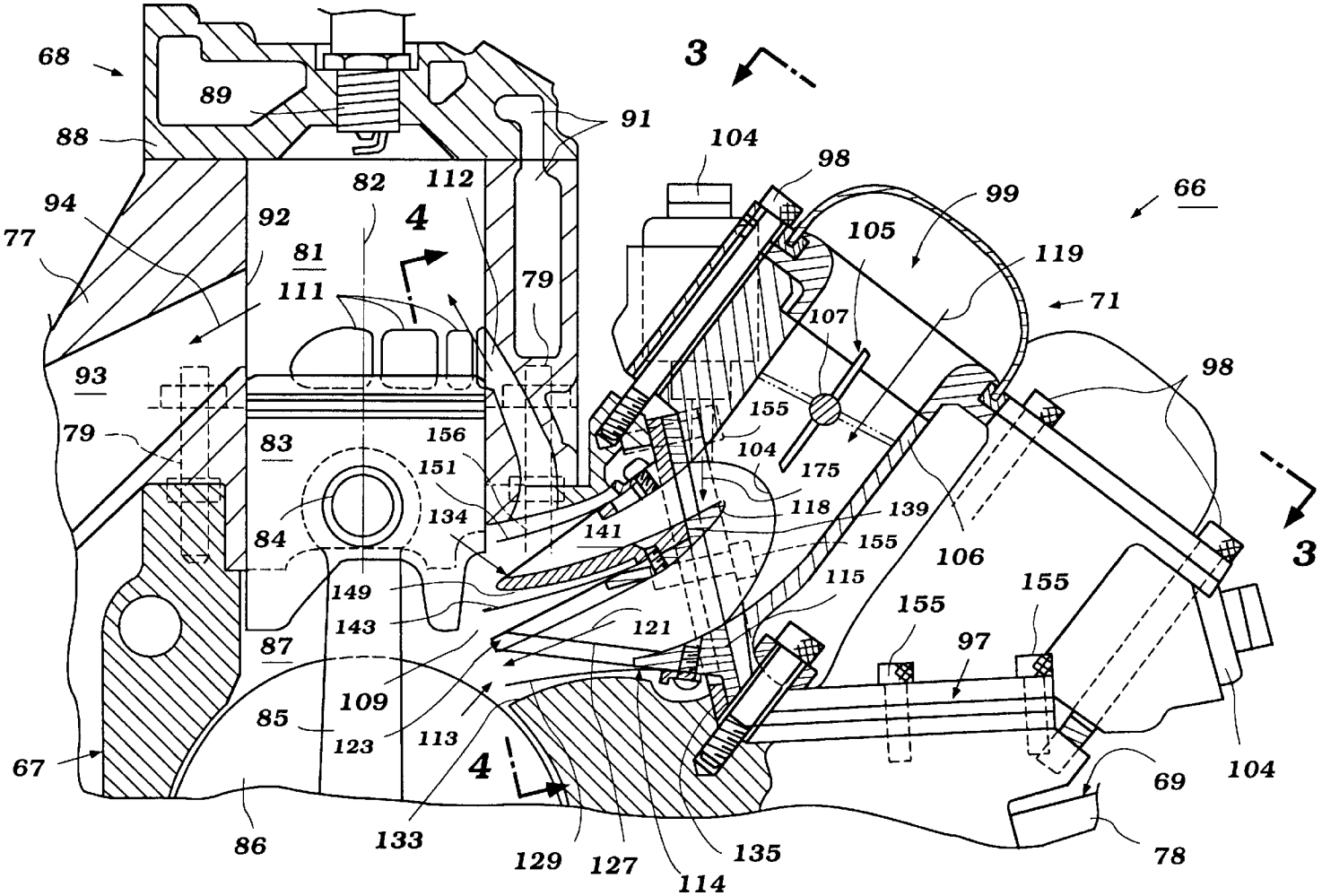
FIG. 2 is an enlarged cross-sectional view taken through a portion of the engine showing the induction system.

As may be seen in FIG. 2, the spray axis of the fuel injector 104 is directed so that it will spray in the direction of the arrow 157 so as to impinge upon the dividing portion 118 of the mounting plate 114 and thus direct slightly more fuel to the upper passageway 117 and valved passageways 142 than the lower passageway. This fuel will tend to flow more directly into the scavenge port 112 and thus provide some degree of stratification, even with a crankcase compression engine wherein fuel is delivered to the crankcase chambers.

Figure 7:
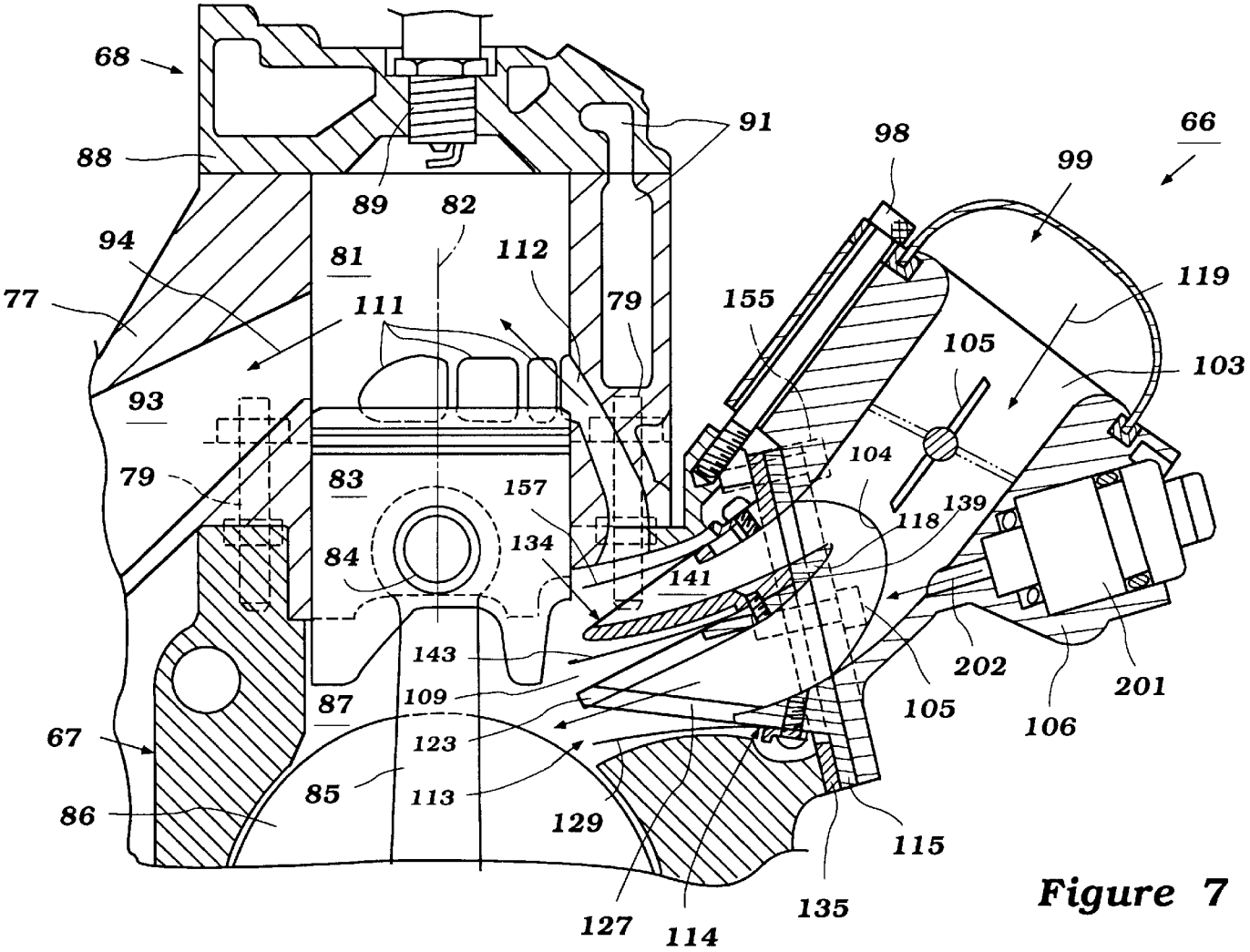
FIG. 7 is a cross-sectional view, in part similar to FIG. 2, and shows another embodiment of the invention.
Figure 8:
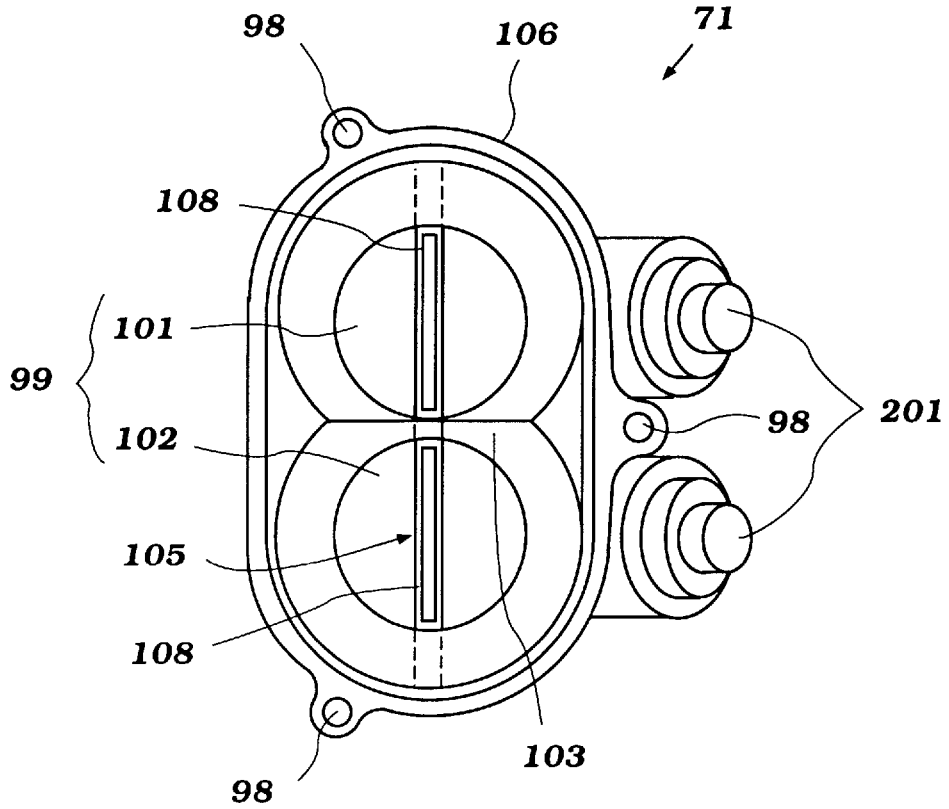
FIG. 8 is a partial view, in part similar to FIG. 3, but shows the construction of this embodiment.

FIGS. 7 and 8 show another embodiment of the invention which is generally similar to the embodiment of FIGS. 1–6. Because of this similarity, only a portion of the construction has been illustrated and components which are the same or substantially the same as those in the previously described embodiment have been identified by the same reference numerals and will not be described again.

The main difference between this embodiment and the previously described embodiment is that in this embodiment, the engine is provided with a pair of fuel injectors 201, one for each intake passage 101 and 102 of each manifold 95. These injectors 201 also spray through passages 202 toward the side of the intake passage where the first caging portion 123 and its flow passageway 116 is positioned so as to provide a type of stratification different from that of the previously described embodiment. In all other regards, this embodiment is the same as that previously described and, for that reason, further description of this embodiment is not believed to be necessary.

Figure 9:
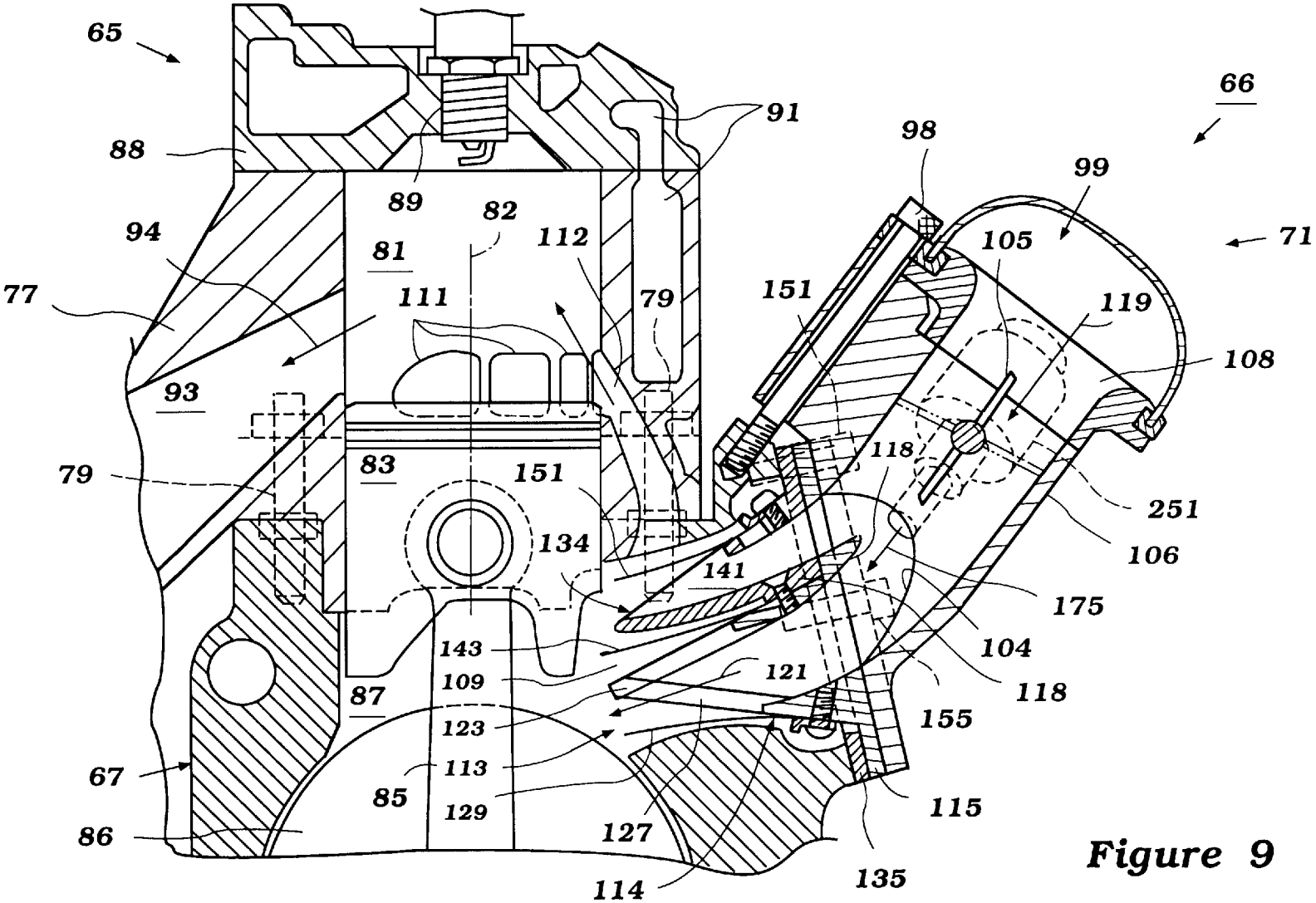
FIG. 9 is a cross-sectional view, in part similar to FIGS. 2 and 7, and shows another embodiment of the invention.
Figure 10:
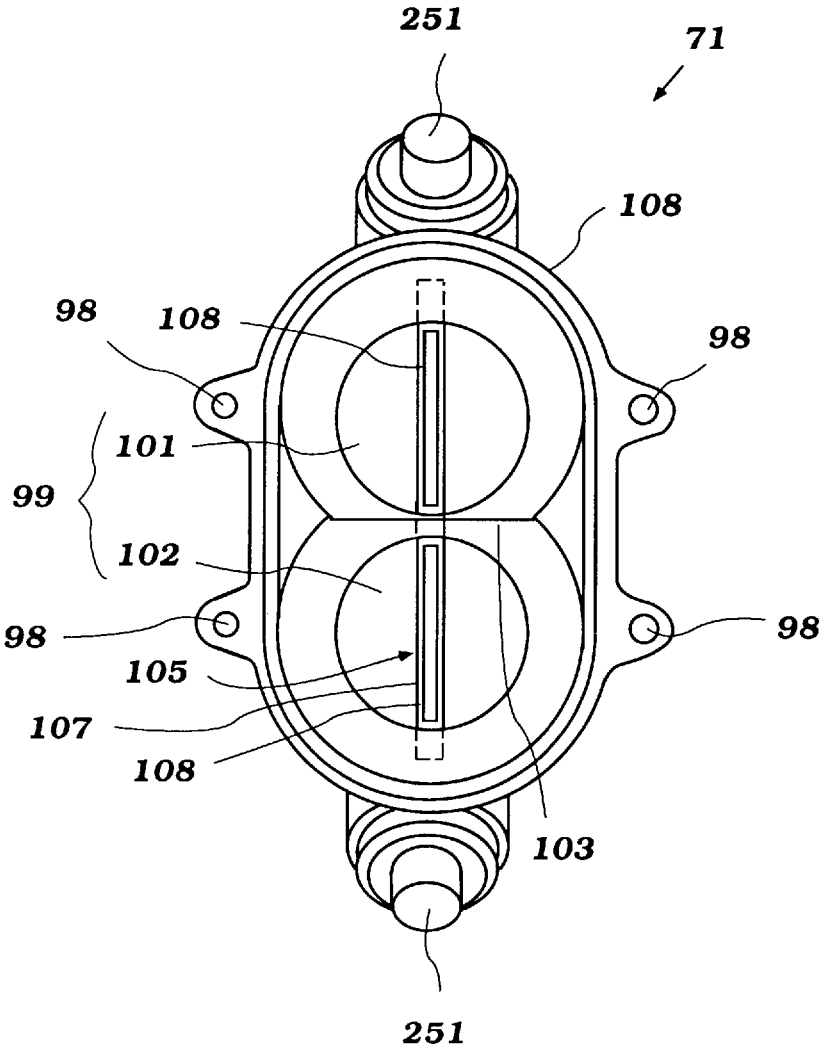
FIG. 10 is an end elevational view, in part similar to FIGS. 3 and 8, showing the construction of the embodiment of FIG. 9.

FIGS. 9 and 10 show another embodiment which, like the embodiment of FIGS. 7 and 8, differs from the embodiment of FIGS. 1–6 only in the location of the fuel injectors. For that reason, components which are the same as that previously described have been identified by the same reference numerals and will not be described again. In this embodiment, there are provided two fuel injectors 251 for each intake manifold 95 with the fuel injectors 251 being disposed so as to inject in a direction generally parallel to the axis of the throttle valve shafts 107 rather than generally perpendicularly to them. The injectors 251 in this embodiment are disposed, like the embodiment of FIGS. 7 and 8, to direct their spray primarily to the portion of the check valve where the first caging member 123 is provided and toward the passage 116. Of course, the injectors 251 could be disposed at an angle so as to spray toward the portion of the passages as in FIGS. 1–6.

Figure 11:
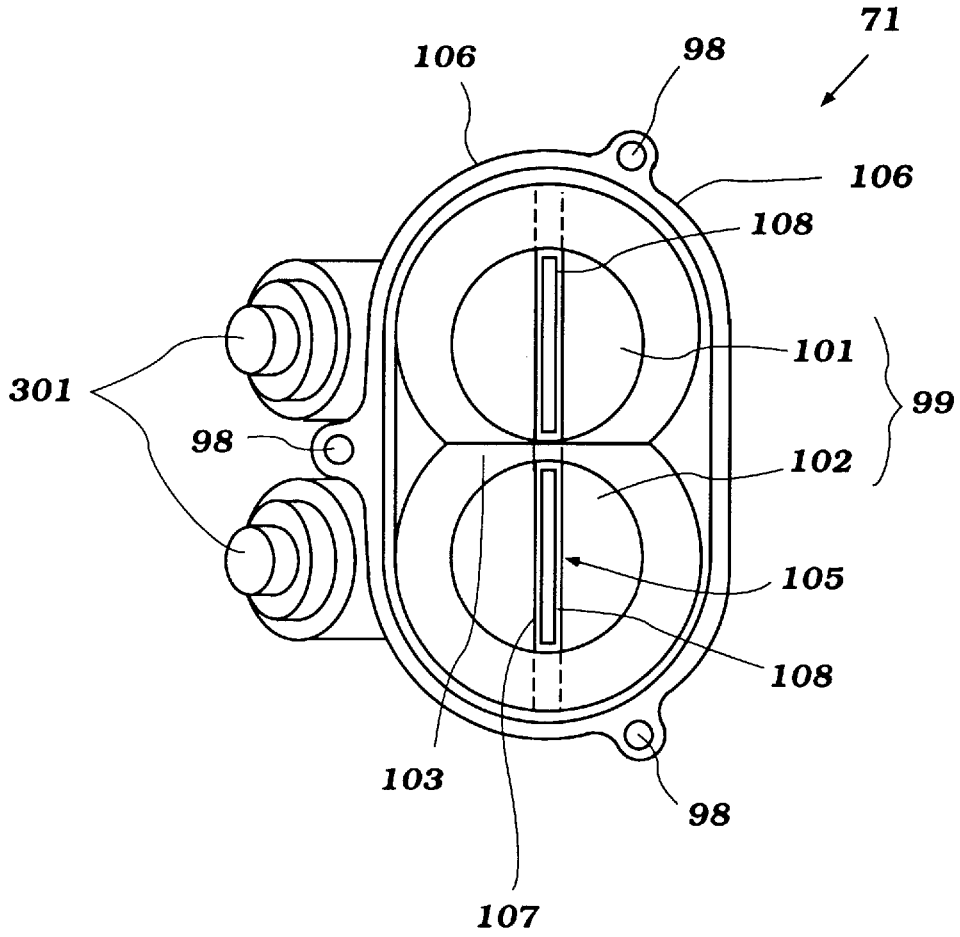
FIG. 11 is an end elevational view, in part similar to FIGS. 3, 8 and 10 and shows yet another embodiment of the invention.

FIG. 11 shows another embodiment of the invention which differs from the previously described embodiments only in the location and number of the fuel injectors. In this embodiment, there are provided two fuel injectors like the embodiment of FIGS. 7 and 8, however, in this embodiment the fuel injectors spray into the intake passage portion 141 formed in the second caging member 139 so as to provide the type of stratification as described in the embodiment of FIGS. 1–6. These fuel injectors are indicated by the reference numeral 301 and except for this difference, this embodiment is the same as that previously described.

Figure 12:
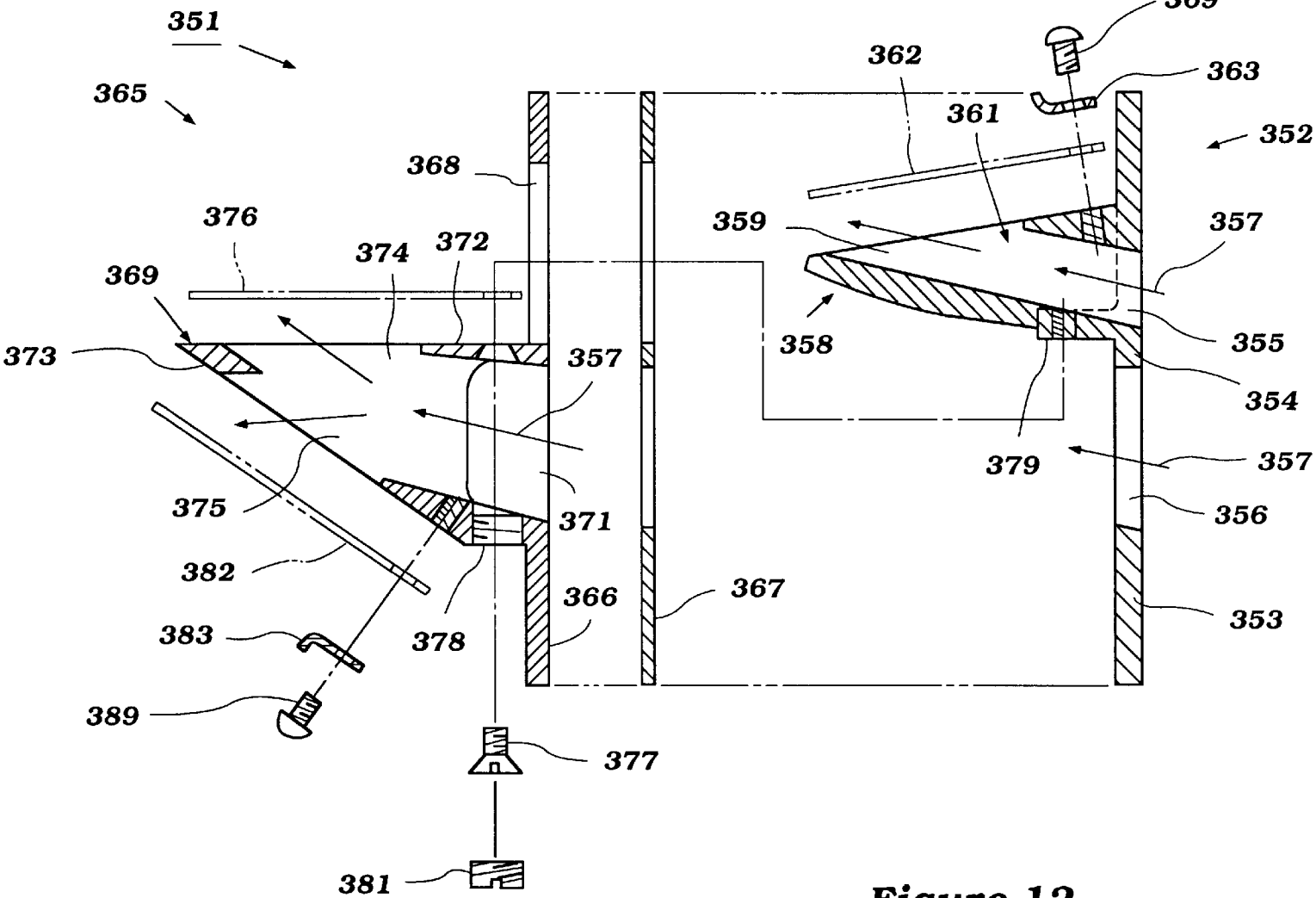
FIG. 12 is an exploded cross-sectional view, in part similar to FIG. 5, and shows another embodiment of the invention.
Figure 13:
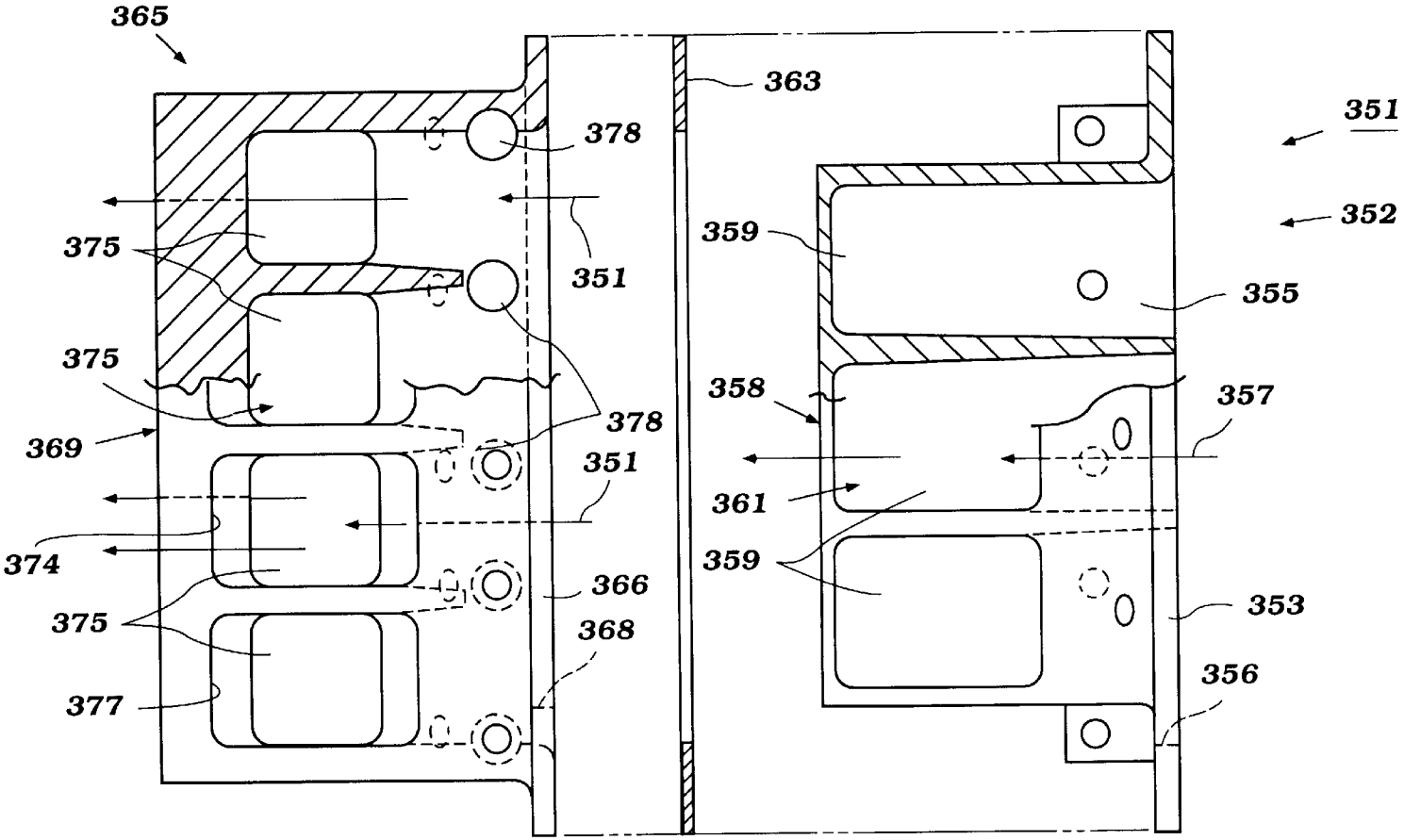
FIG. 13 is a top plan view of the exploded construction for the embodiment of FIG. 12, in part similar to FIG. 6.
Figure 14:
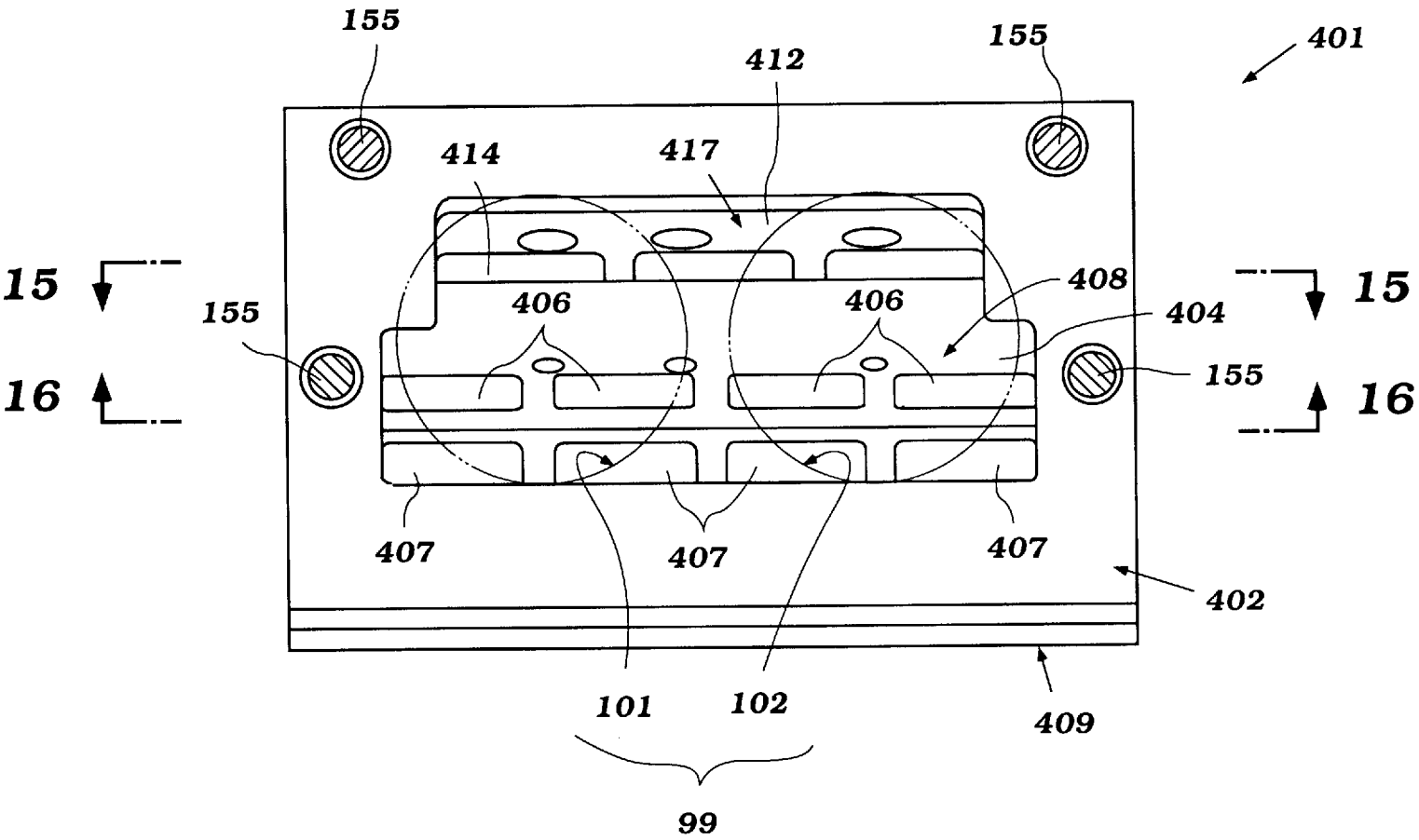
FIG. 14 is an elevational view of a reed type check valve constructed in accordance with another embodiment of the invention looking at the inlet side to the check valve.
Figure 15:
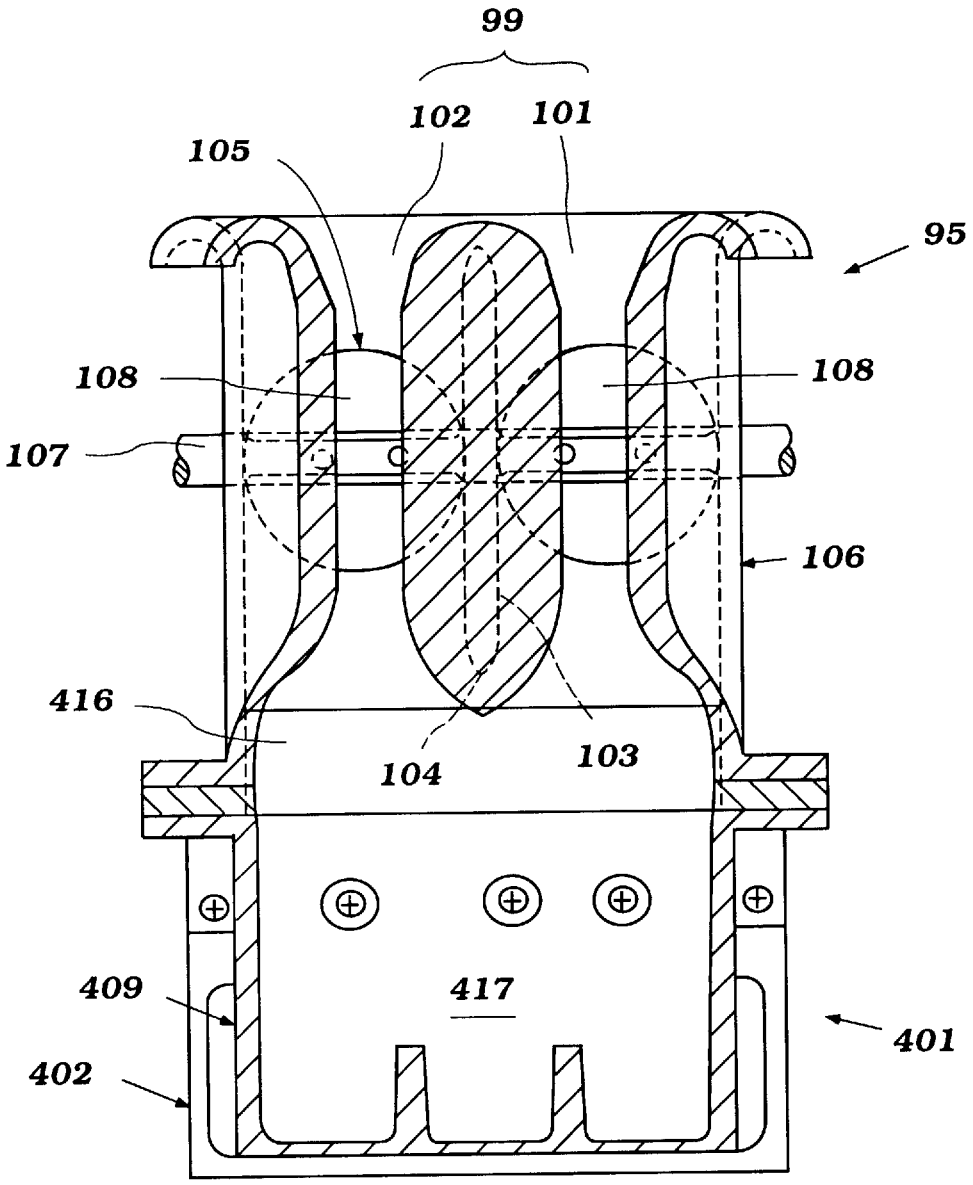
FIG. 15 is a cross-sectional view taken along the line 15—15 of FIG. 14.
Figure 16:
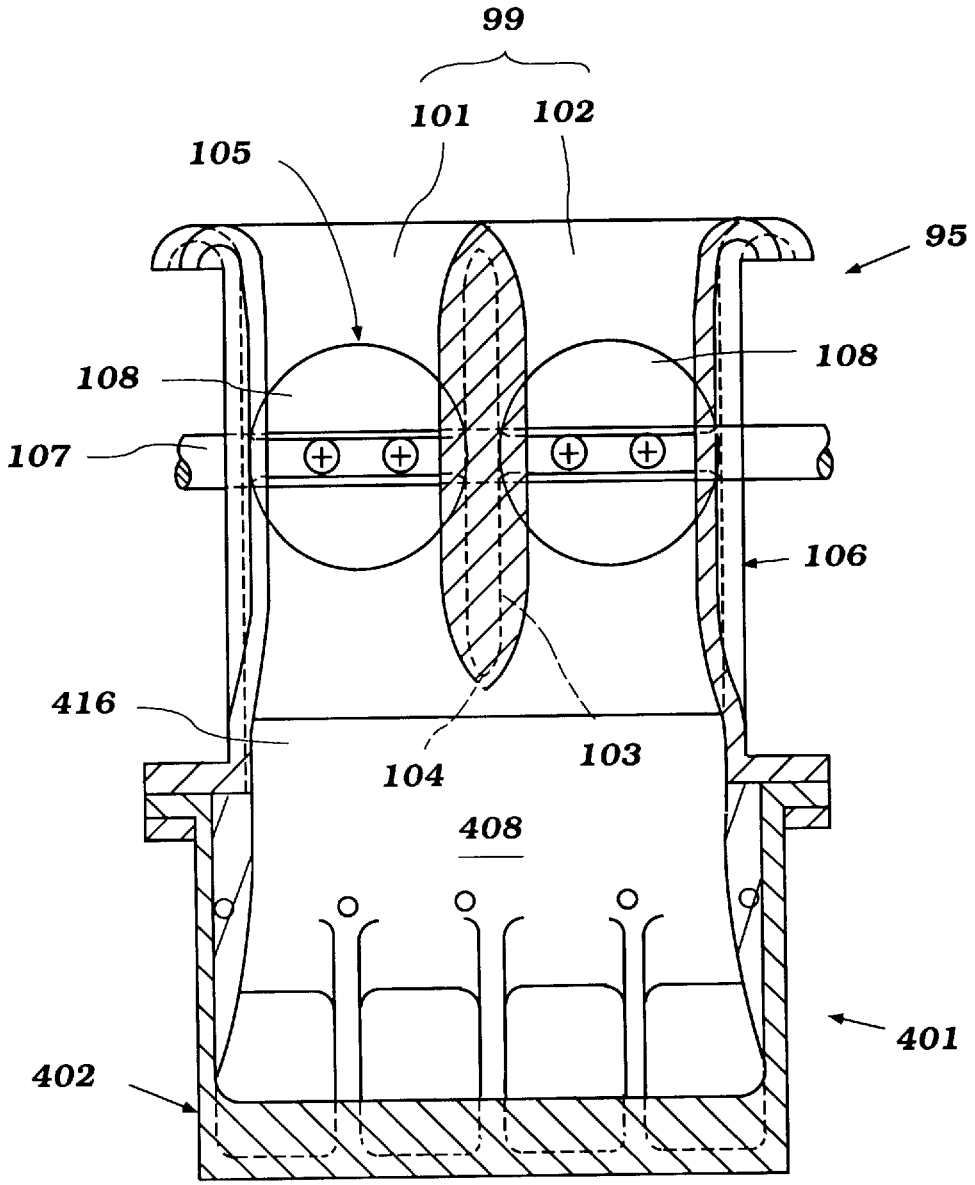
FIG. 16 is a cross-sectional view taken along the line 16—16 of FIG. 14.
Figure 17:
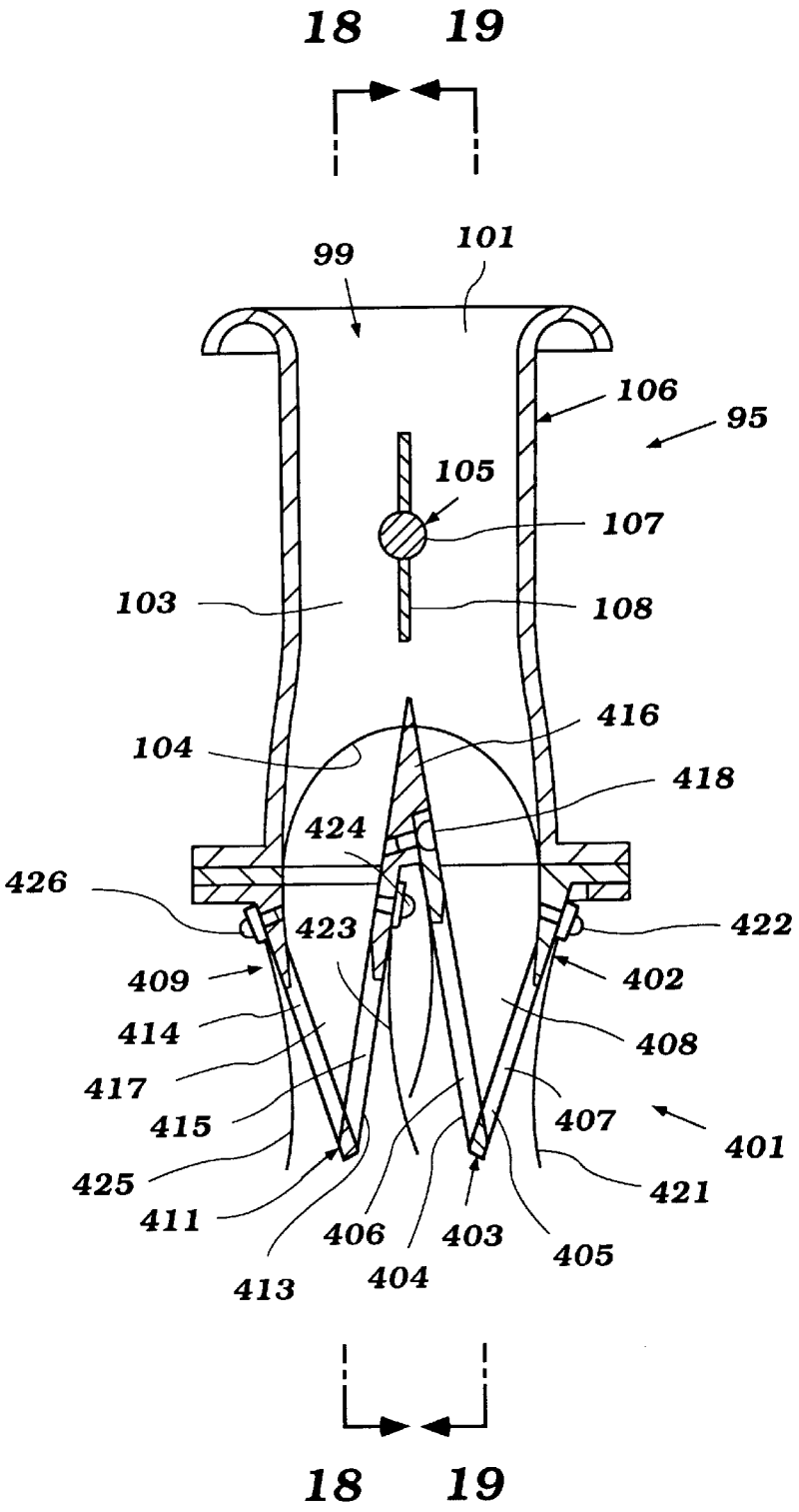
FIG. 17 is a cross-sectional view taken along a plane perpendicular to the plane of FIG. 16 and through the center of one of the intake passages.
Figure 18:
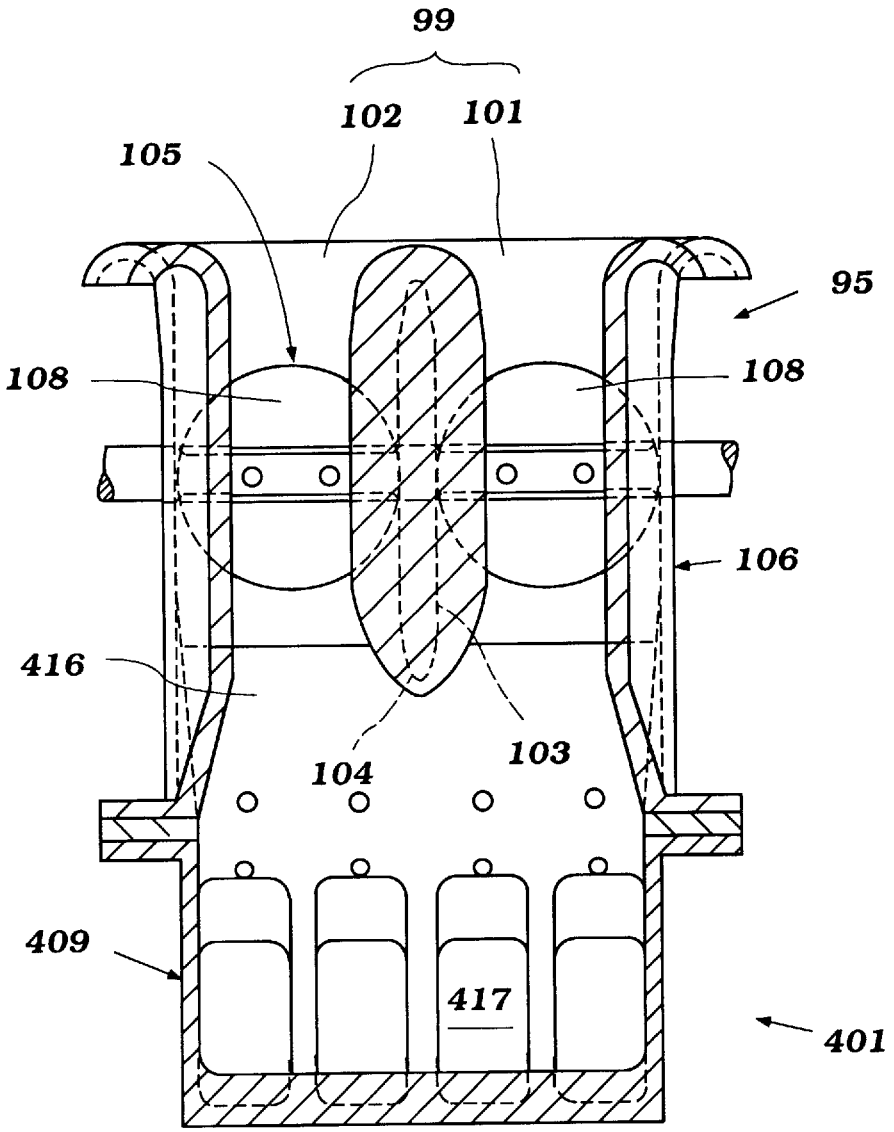
FIG. 18 is a cross-sectional view taken along the line 18—18 of FIG. 17.
Figure 19:
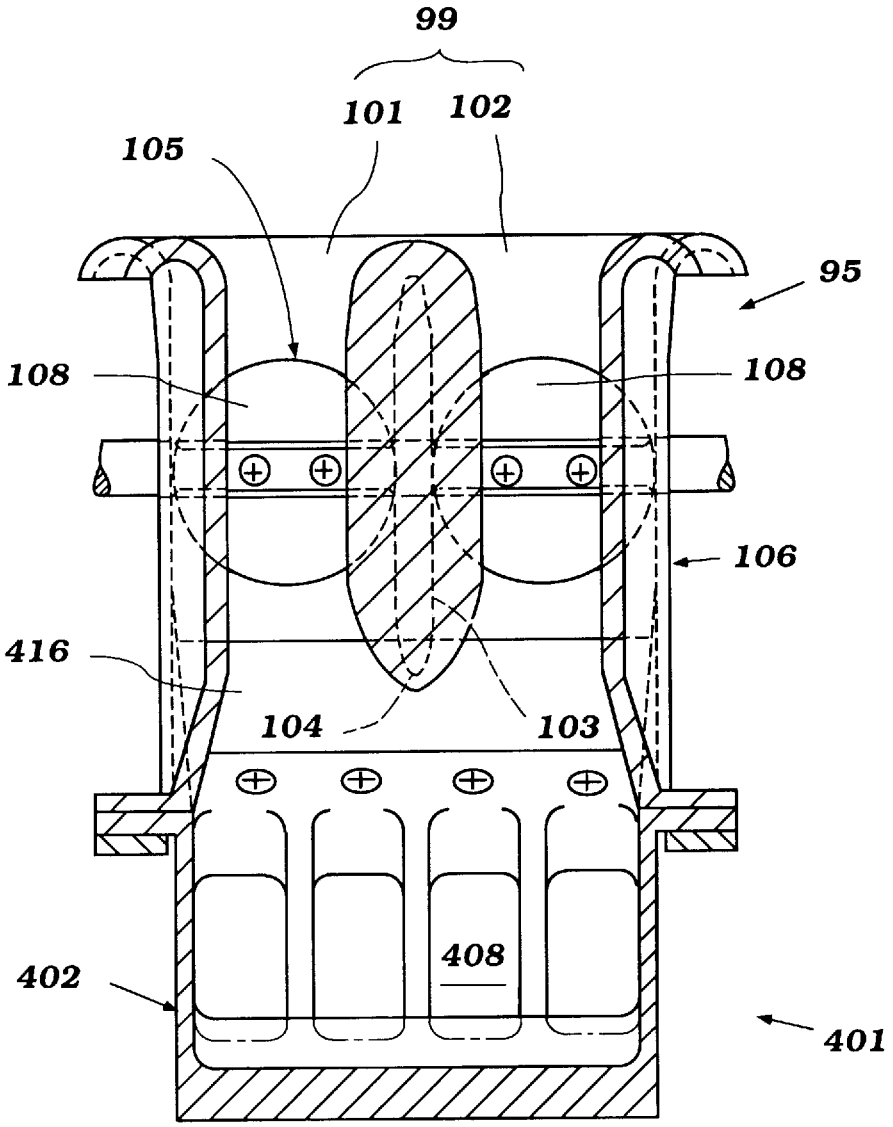
FIG. 19 is a cross-sectional view taken along the line 19—19 of FIG. 17.

FIGS. 12 and 13 show another embodiment of the invention which is generally the same as the previously described embodiments. This embodiment differs from those previously described only in the way in which the portions of check valve assemblies 113 are secured to each other. In the previously described embodiment, the mounting portion 114 was formed with the two-sided check valve caging member 123 while the second check valve caging member 134 which was affixed primarily to the mounting portion 114 was formed with only a single check valved series of three openings. FIGS. 12 and 13 show how this construction can be reversed and except for this difference and the way in which the components are fastened to each other, the construction is generally the same as FIGS. 5 and 6.

In this embodiment, the check valve assembly is identified generally by the reference numeral 351 and includes a first mounting portion 352 having a flange part 353 that is affixed, as previously described, between the individual intake manifolds 95 and the crankcase 67.

A dividing wall 354 defines a pair of flow openings 355 and 356 through which air may flow in the direction of the arrow 357. In this embodiment, the dividing wall 354 does not extend any distance into the intake passage of the manifold and hence does not truly function as a rectifier plate like the previous embodiments.

A first caging member 358 extends integrally from the flange 353 and defines a continuation of the opening 355 which terminates in three rectangularly shaped valved openings 359. These openings are formed in a surface 361. A first reed type check valve element 362 is affixed to the surface 361 by means of a retainer plate 363 and a plurality of threaded fasteners 364. The valve element 362 has three leaved portions, each of which cooperates to control the flow through a respective one of the valved openings 359.

A second caging member, indicated generally by the reference numeral 365, has a flange portion 366 that is adapted to engage the flange portion 353 with a sealing gasket 367 being interposed therebetween, if desired. The flange portion 366 has an opening 368 sized to receive the caging member 358 and permit continuation of the flow therethrough. In addition, there is provided a caging member portion 369 having an inlet opening 371 that mates with the flange opening 357 of the mounting portion 352 for a continuation of flow in the direction of the arrow 357. This caging portion 369 has a pair of angular related surfaces 372 and 373 in which respective valved openings 374 and 375 are formed. There are four of each of the openings 374 and 375.

A second reed type valving element 376 is affixed to the surface 372 and the second caging member 369 is affixed to the mounting member 352 by a series of four threaded fasteners 377 which pass through enlarged tapped openings 378 in the surface 375 and through openings in the surface 372. The fasteners 377 are threaded into tapped openings 379 formed in the caging member 358. Once the screws 377 are passed through the openings 378, the openings 378 are closed by threaded plugs 381.

A third reed type valving element 382 is affixed to the surface 373 by means of a retainer plate 383 and threaded fasteners 384. From the description of FIGS. 1–6, it should be readily apparent how the embodiment of FIGS. 12 and 13 operates and, for that reason, further description of this embodiment is not believed to be necessary.

FIGS. 14–19 show another embodiment of the invention which is generally similar to the embodiment of FIGS. 1–6. For that reason, only the reed valve assembly, indicated generally by the reference numeral 401 in these figures, and its cooperation with the intake manifolds 95 is illustrated and will be described. Since the intake manifolds 95 are the same as those previously described, the same reference numerals have been applied to these components. The difference between this embodiment and that of FIGS. 1–6 is that this embodiment employs four sets of reed valved passages while all of the embodiments previously described only employ three sets of reed valved passages.

The reed valve assembly 408 includes a mounting portion 402 having a caging member 403 defined by a pair of planar surfaces 404 and 405. Each of the planar surfaces 404 and 405 is provided with a series of four reed valved openings 406 and 407, respectively. These openings communicate with a chamber 408 formed between the surfaces 404 and 405 and which communicates at its upstream end with the intake passages 101 and 102 on one side of the throttle valve plate 108.

A second reed valve member 409 also forms a caging portion 411 by means of a pair of angularly inclined surfaces 412 and 413. Three reed valved openings are formed in each of the surfaces 412 and 413, these openings being indicated respectively by the numbers 414 and 415.

A dividing wall 416 of the member 409 extends into the intake passages 101 and 102 downstream of the throttle valves 108 and divides the flow into the passageway 408 of the caging member 403 and a corresponding passageway 417 of the caging member 411. In this embodiment, the dividing wall for 416 also extends into the intake passages 101 and 102 and in proximity to the dividing wall 103 to function as a rectifier plate for directing the air flow.

Threaded fasteners 418 interconnect the valve members 402 and 409 to each other and also hold a reed valve element 419 in place. The valve element 419 has four fingers that control the flow through respective ones of the openings 406. A reed valve element 421 is affixed to the surface 405 by fasteners 422 for valving the openings 407. In a like manner, a reed valve element 423 is held to the surface 413 by threaded fasteners 424 and has fingers that valve the openings 415. A reed valve element 425 is fixed to the surface 412 by threaded fasteners 426 and has fingers which valve the openings 414.

As with the previously described embodiment, the valve openings 406, 407, 414 and 415 have a surface area which is approximately equal to the flow areas provided for by the intake passages 101 and 102 of the manifolds 95 so as to offer very low flow resistance. In all other regards, this embodiment is substantially the same as those previously described and, for that reason, further description of this embodiment is believed to be unnecessary to enable those skilled in the art to understand and practice the invention.

Figure 20:
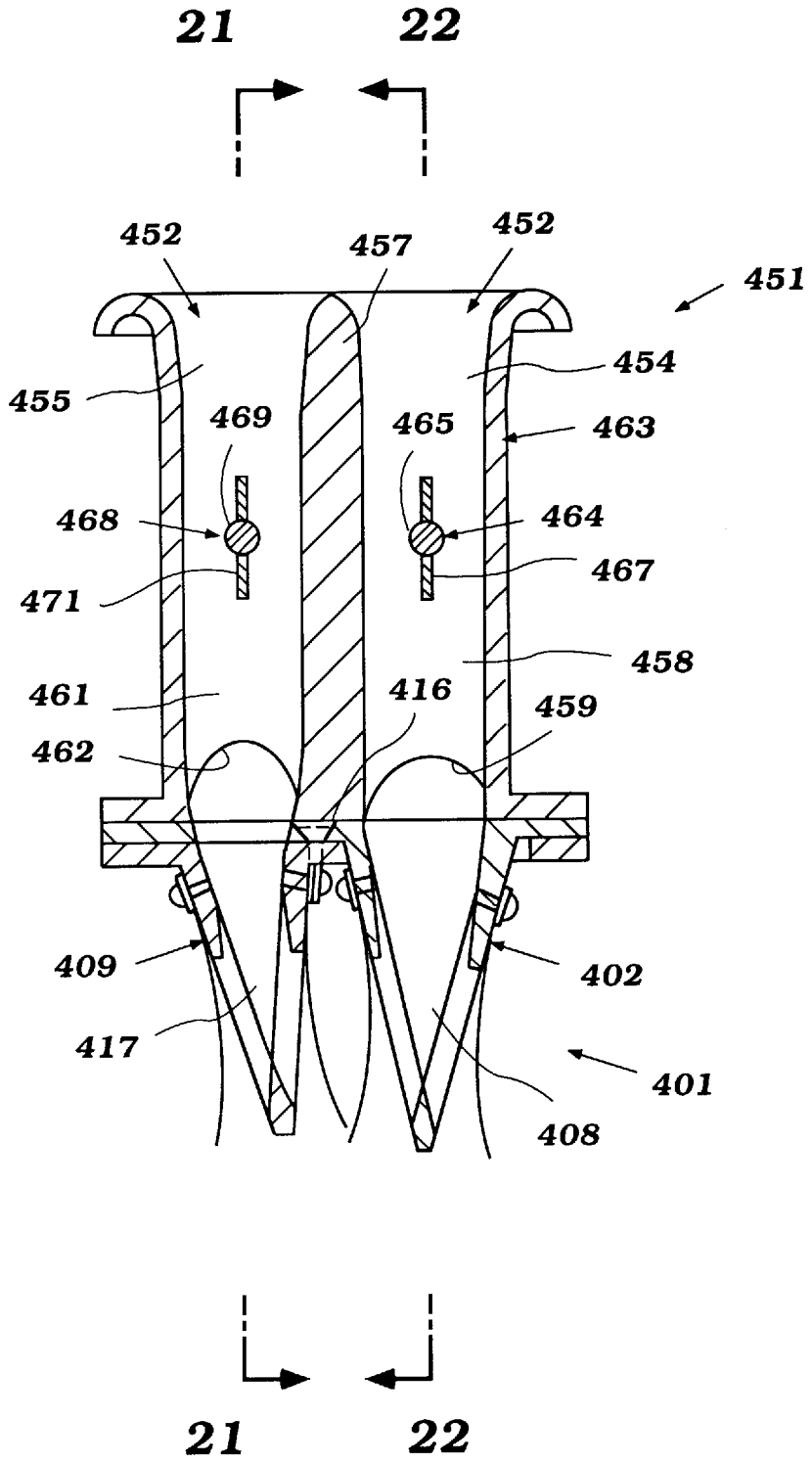
FIG. 20 is a cross-sectional view, in part similar to FIG. 17, and shows yet another embodiment of the invention.
Figure 21:
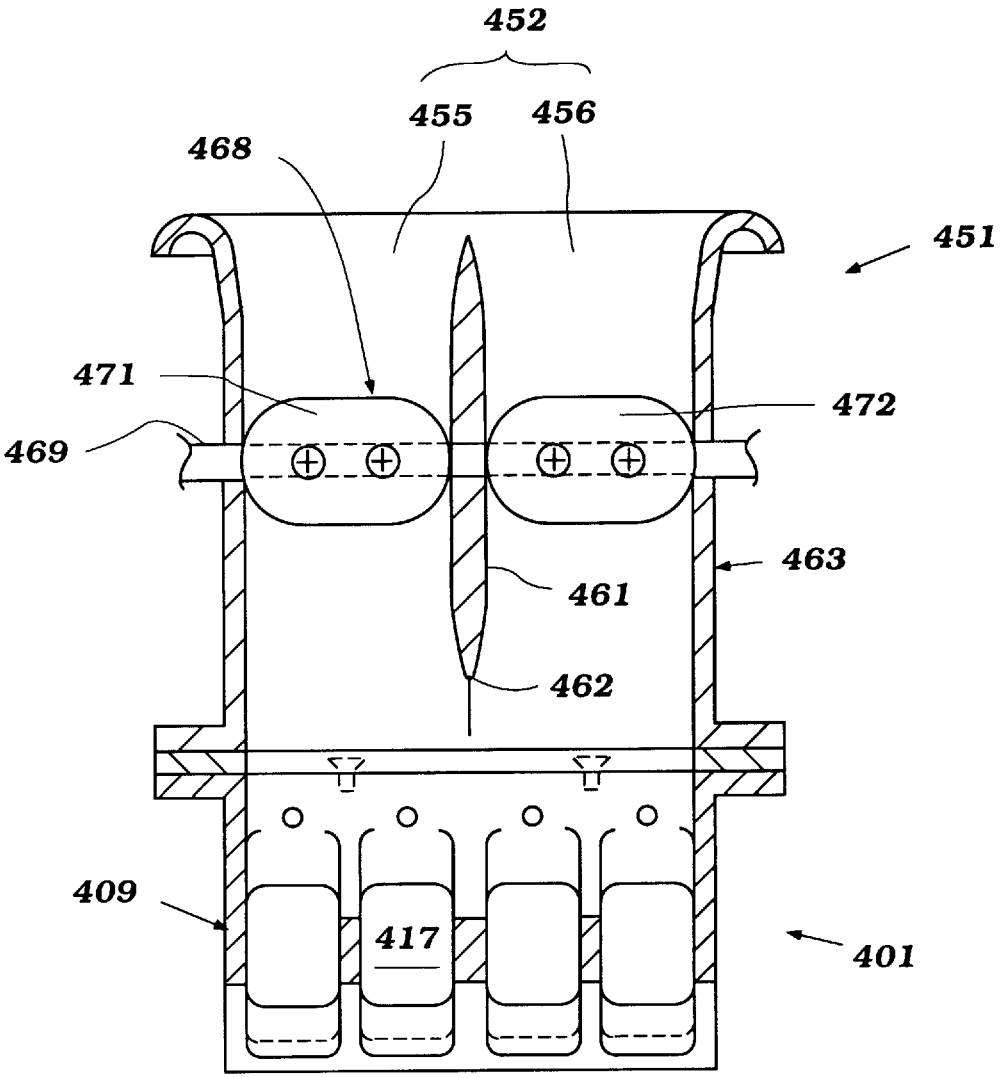
FIG. 21 is a cross-sectional view taken along the line 21—21 of FIG. 20.
Figure 22:
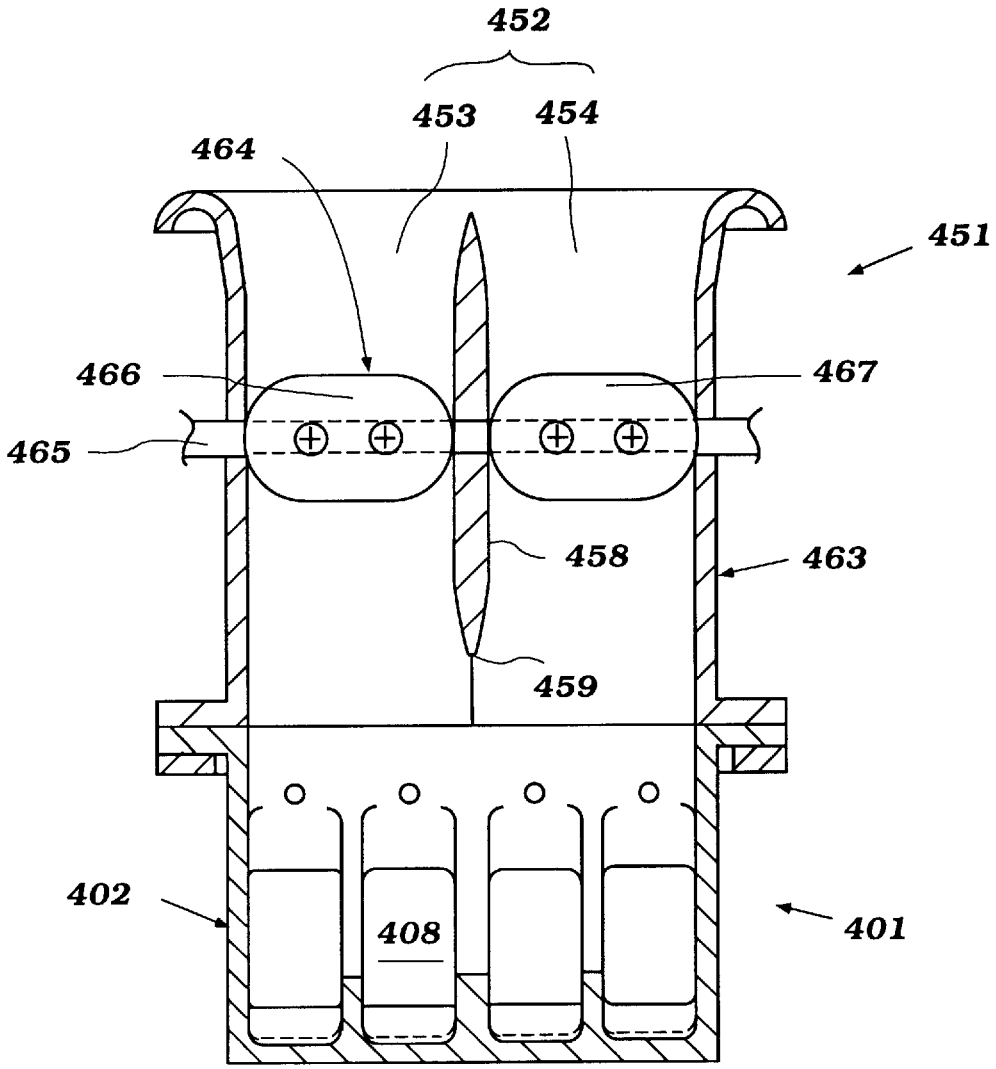
FIG. 22 is a cross-sectional view taken along the line 22—22 of FIG. 20.

In all of the embodiments of the invention as thus far described, two generally cylindrical intake passages 101 and 102 of the intake manifolds 95 have served the respective reed valve assemblies. These intake passages were disposed in side-by-side fashion in a direction extending parallel to the apexes of the reed type valve caging members. As a result, the throttle valves 105 have not been possible to provide any significant staging of the opening of the passages served by the individual reed valving elements. FIGS. 20–22 shows a first embodiment of a throttle valve arrangement and intake passage arrangement which permits staging in the flow and hence, can provide a better stratification effect, if desired, or different fuel/air ratios passing through the individual valving elements of the reed type valve assemblies. This embodiment employs a reed type valve assembly 401 of the type illustrated in the embodiment of FIGS. 14–19 and for that reason the reed type valve assembly 401 and its various components have been identified by the same reference numerals and will not be described again, except insofar as it relates to the intake passage system formed by the manifold, now to be described.

In this embodiment, an intake manifold, indicated generally by the reference numeral 451 is provided for each cylinder of the engine. As with the previously described embodiments, the intake manifolds 451 associated with each cylinder may be formed from a common part. However, there are a number of advantages in forming the intake manifolds 451 for each cylinder separately from each other. Alternatively in this and in the other embodiments, the intake manifolds for each cylinder bank may be formed as unitary assemblies.

The intake manifold 451 is provided with an induction passage 452 which in this embodiment is actually divided into four individual induction passages that have a generally oval configuration in cross-sectional flow areas. These intake passages comprise a first pair of intake passages 453 and 454 which communicate in side-by-side fashion with the caging member cavity 408 of the reed valve assembly 401. The passages 453 and 454 are separated from a further pair of passages 455 and 456 which communicate with the caging member recess 417 formed by the caging member 409 of the reed valve assembly 401. A wall 457 separates the intake passages 453 and 454 from the intake passages 455 and 456 and this wall 457 abuts with the dividing wall 416 of the reed valve assembly 401 so that the flow to the caging chambers 408 and 417 is completely separated from each other.

The passages 453 and 454 are separated from each other by an internal wall 458 which has a cutout 459 at its lower end so that the passages 453 and 454 have some communication immediately above the caging member cavity 408 as clearly shown in FIG. 22. In a similar manner, the passages 455 and 456 are separated from each other by a vertical wall 461 which has a cutout 462 at its lower end so that these passages 455 and 456 communicate with each other immediately above the cavity 417 of the caging member 409.

The intake passages 453, 454, 455 and 456 are formed in a generally oval body portion 463 of the intake manifold 451. A first throttle valve assembly, indicated generally by the reference numeral 464, is provided for controlling the flow through the intake passages 453 and 454. This throttle valve assembly 464 includes a throttle valve shaft 465 that passes through the centers of the intake passages 453 and 454 and which has butterfly type valve plates 466 and 467 affixed to it in the respective intake passages 453 and 454 so as to control the flow through them.

In a similar manner, a throttle valve assembly, indicated generally by the reference numeral 468, is provided for controlling the flow through the intake passages 455 and 456. This throttle valve assembly 468 includes a throttle valve shaft 469 that is rotatably journaled in the body portion 463 of the manifold 451. A pair of butterfly type throttle valve plates 471 and 472 are affixed to the shaft 469 within the passages 455 and 456, respectively, for controlling the flow through them.

This type of valving arrangement including the separate throttle valves 464 and 468 permits a staged operation, as will become apparent, so that flow may occur into the intake system at low and mid range speeds only through one of the caging member cavities 408 or 417 with both passages being served at high speed, high load conditions.

Figure 23:
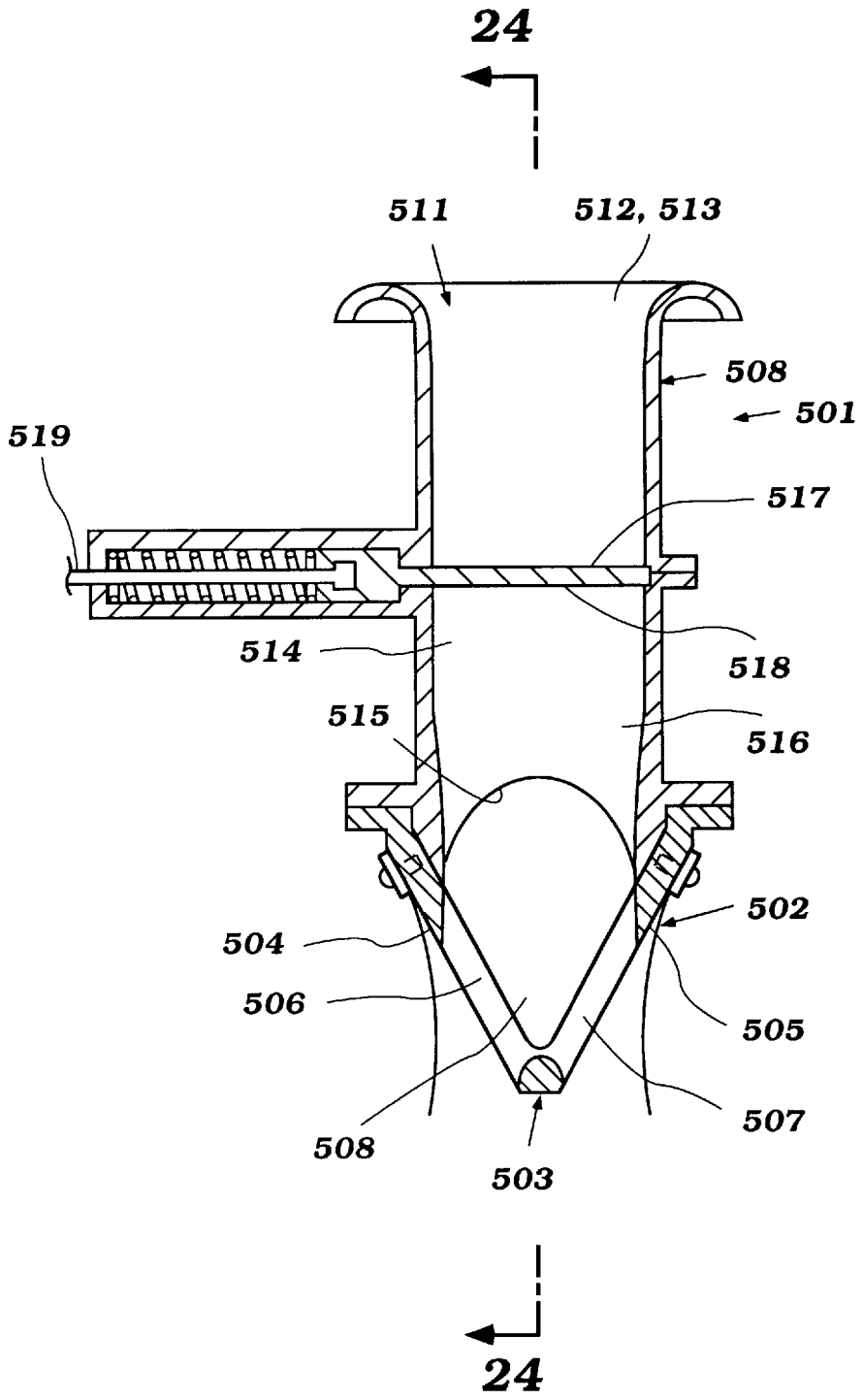
FIG. 23 is a cross-sectional view, in part similar to FIGS. 17 and 20, and shows another embodiment of the invention.
Figure 24:
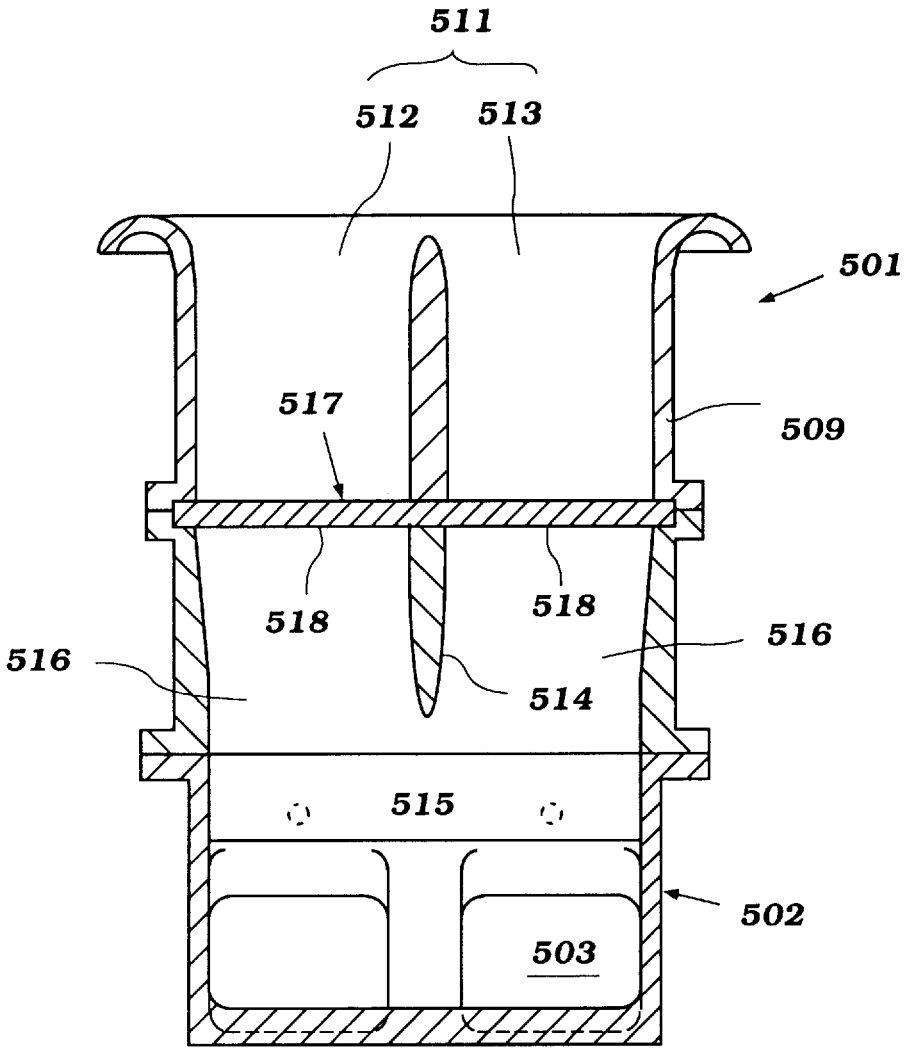
FIG. 24 is a cross-sectional view taken along the line 24—24 of FIG. 23.

In all of the embodiments thus far described, the throttle valve assemblies for controlling the flow through the intake passages of the intake manifolds have been of the butterfly type. It is to be understood, however, that the invention may also be used with other types of throttle valves and FIGS. 23 and 24 show an embodiment wherein slide type throttle valves are employed. In this embodiment, an intake manifold, indicated generally by the reference numeral 501, is provided that cooperates with a reed type valve assembly, indicated generally by the reference numeral 502. In this embodiment, the reed type valve assembly 502 is of the generally conventional type having a caging member 503 that defines a pair of intersecting surfaces 504 and 505 in which pairs of respective valved openings 506 and 507 are provided. These valved openings communicate with a chamber 508 formed by the caging member 503. Although the invention is described in conjunction with a conventional type of reed valving element 502, it will be readily apparent to those skilled in the art how this embodiment can be employed with any of the previously described types of reed valve assemblies.

In this embodiment, the intake manifold 501 has a main body portion 509 that defines an intake passage 511 which is divided into a pair of side-by-side passages 512 and 513 by an internal dividing wall 514. The wall 514 has a cutout 515 formed at its lower end which permits the passages 512 and 513 to communicate with each other at their discharge ends 516, which discharge ends communicate with the cavity 508 of the reed valve assembly 502.

A slide type throttle valve 517 is slidably supported within the body 509 and has a blade portion 518 that extends into each of the intake passages 512. A throttle cable 519 is affixed to the slide type valve 517 for sliding it and effecting its opening and closing, as is well known in this art. It will be noted that as the throttle valve 517 is initially opened, more flow will tend to flow through the reed valved openings 507 than through the reed valved openings 506 and hence, some form of stratification can be achieved.

In all of the embodiments thus far described, although each chamber of each caging member may have been served by two separate intake passages each having its own throttle valve, there has been some communication between these two intake passages immediately adjacent the cavity of the caging member. Next will be described a series of embodiments wherein the intake passages which serve each caging member cavity are separated from each other and the caging member cavities are separated from each other. This may be done to achieve greater stratification and/or turbulence and/or different fuel/air ratios flowing through each part of the valve cavities.

Figure 25:
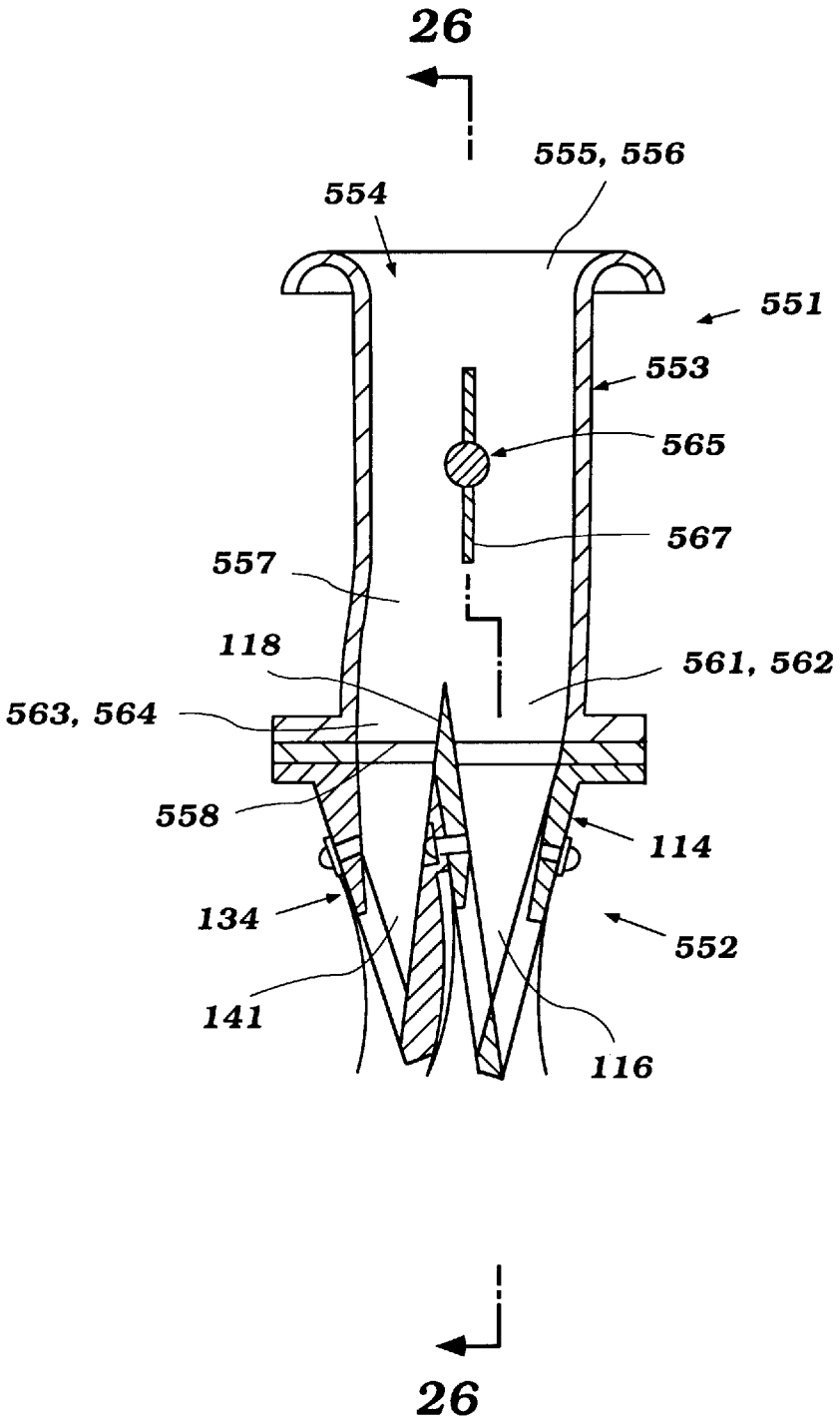
FIG. 25 is a cross-sectional view, in part similar to FIGS. 17, 20 and 23 and shows yet another embodiment of the invention.
Figure 26:
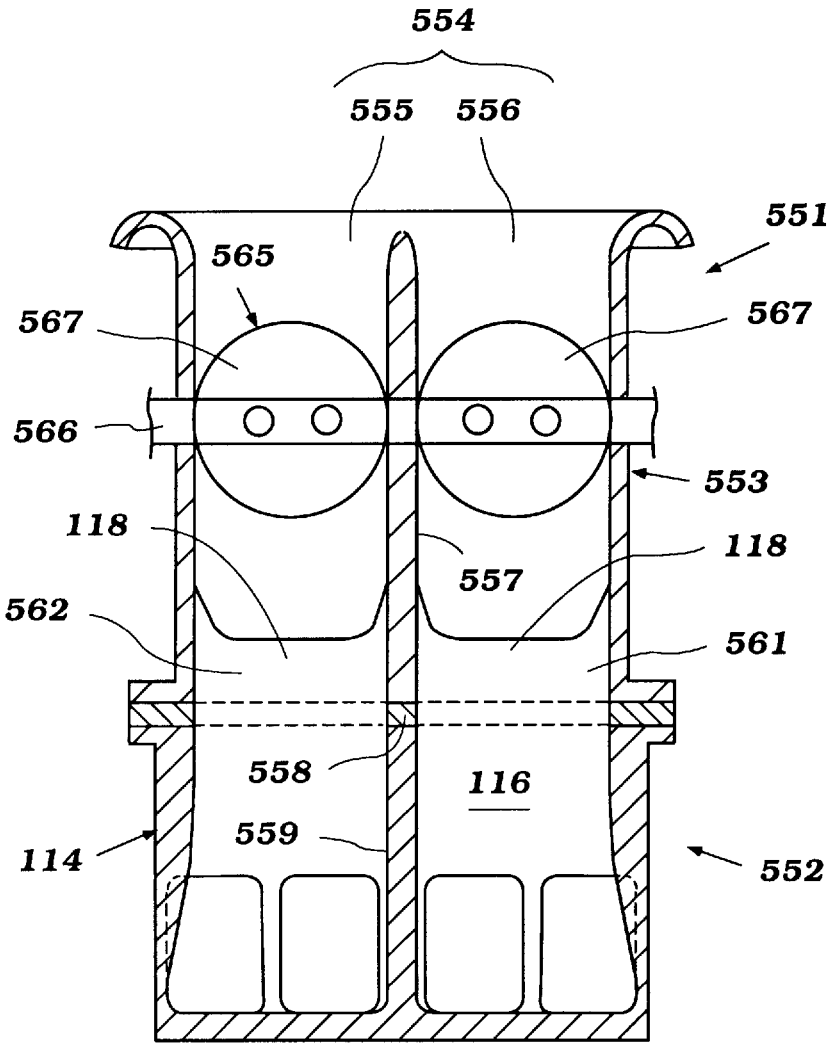
FIG. 26 is a cross-sectional view taken along the line 26—26 of FIG. 25.

Referring first to FIGS. 25 and 26, these illustrate an intake manifold 551 which cooperates with a reed valving assembly 552. The reed valving assembly 552 in this embodiment has the same general construction as the reed valving assembly 113 of the embodiment of FIGS. 1–6, except for a difference which will be noted. Because of this otherwise similarity, components of the reed valving assembly 552 which are the same as the embodiment previously mentioned have been identified by the same reference numerals and those components will not be described again, except insofar as is necessary to understand the construction and operation of this embodiment.

In this embodiment, the intake manifold 551 has a main body portion 553 that forms an intake passage 554 that is divided into a first portion 555 and a second portion 556 by an internal wall 557. Unlike the previously described embodiments, however, the wall 557 does not terminate short of the reed valve assembly 552. Rather, it has a lower edge 558 that is abuttingly engaged with not only the dividing portion 118 of the reed valve assembly 552 but also which is abuttingly engaged with an internal wall 559 that extends through each of the caging portions of the reed valve assembly 552 so as to divide their respective chambers 116 and 141 into first and second parts. These parts appear at 561 and 562 in FIG. 26. Similar parts are formed at 563 and 564 in the valve chamber 141 (FIG. 25).

As with the previously described embodiments, a throttle valve assembly, indicated generally by the reference numeral 565 is provided for controlling the flow through the intake passages 555 and 556. The throttle valve assembly 565, in this embodiment, is comprised of a throttle valve shaft 566 on which a pair of butterfly type plates 567 are affixed for controlling the flow through the passages 555 and 556, respectively. If the valve plates 567 were fixed to separate shafts, then their staged operation, to be described, could effect stratification between the flow through the respective divided chambers of the reed valve assembly 552.

Figure 27:
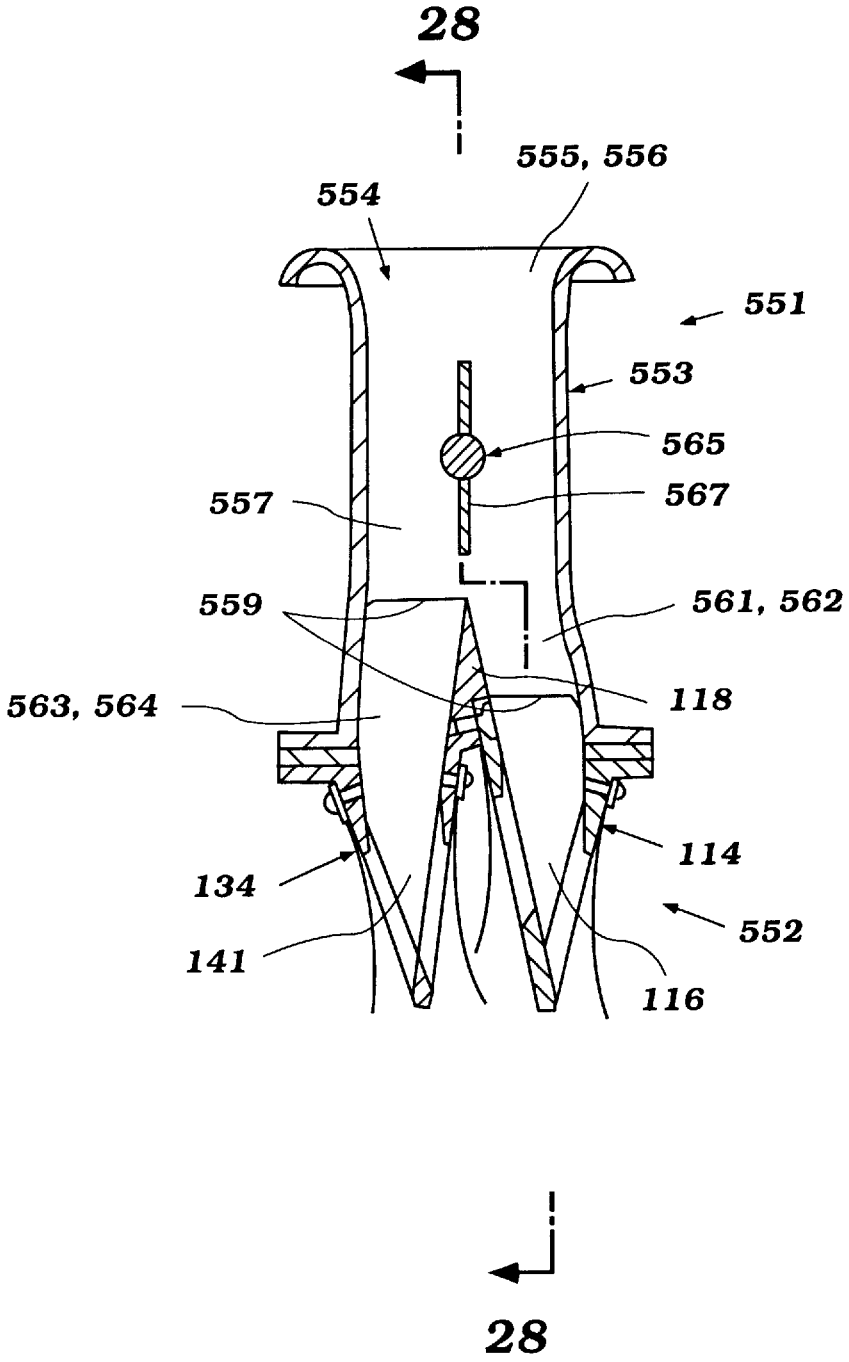
FIG. 27 is a cross-sectional view, in part similar to FIGS. 17, 20, 23 and 25, showing yet another embodiment of the invention.
Figure 28:
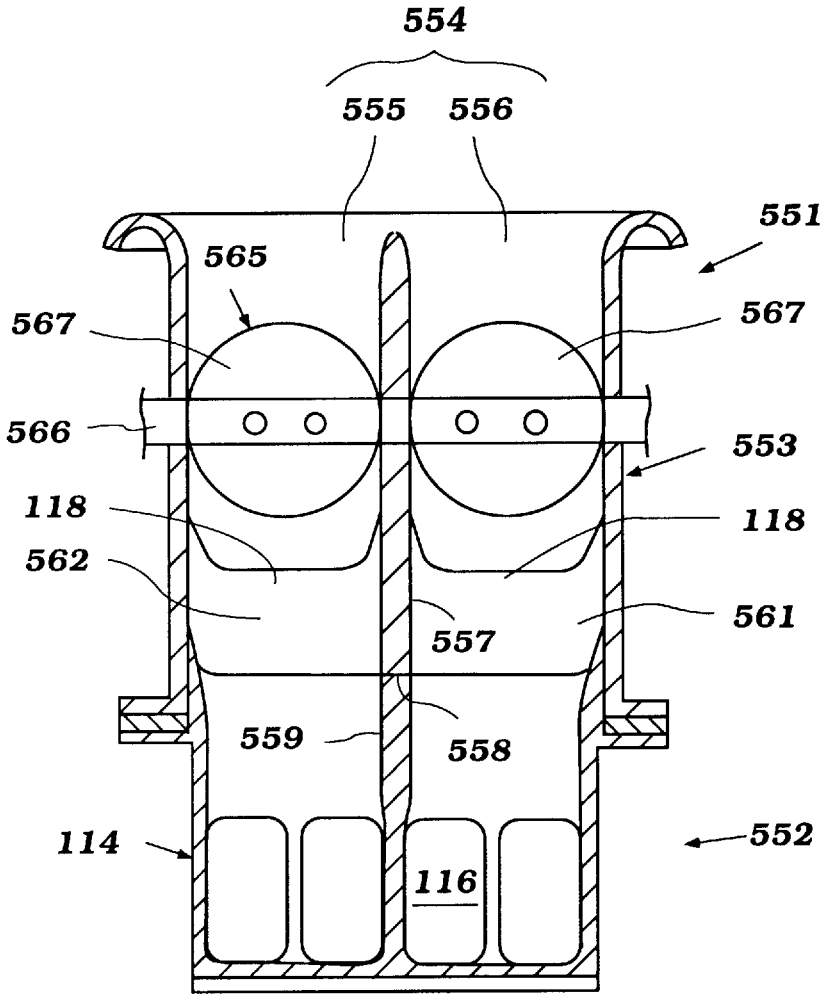
FIG. 28 is a cross-sectional view taken along the line 28—28 of FIG. 27.

FIGS. 27 and 28 illustrate another embodiment which is generally the same as the embodiment of FIGS. 25 and 26 and, for that reason, the same or similar components have been identified by the same reference numerals and will be described again only insofar as is necessary to understand the differences between this embodiment and the previously described embodiment.

In the previously described embodiment, the intake passages 555 and 556 both serve the chambers 116 and 141 of the respective caging members of the reed valve assembly 114. This embodiment illustrates a way in which the throttle valve assembly 565 can also separate the flow from one side to the other. This is done by extending the dividing wall 118 of the reed valving portion 114 up to a point closely adjacent the lower tips of the valve plates 567 when in their full throttle position as clearly shown in FIGS. 27 and 28. As a result, the opening and closing of the throttle valve plates 567 will provide the stratification in the flow from one side of each intake passage 555 or 556 to the valve chamber 141 and to the valve chamber 116. In this embodiment, the edge 558 of the dividing wall 557 is also stepped so that the division of the chamber 114 extends up to the throttle valve plates 567 in their fully opened position while the division between the chambers 116 is somewhat lower as clearly shown in FIG. 27.

Figure 29:
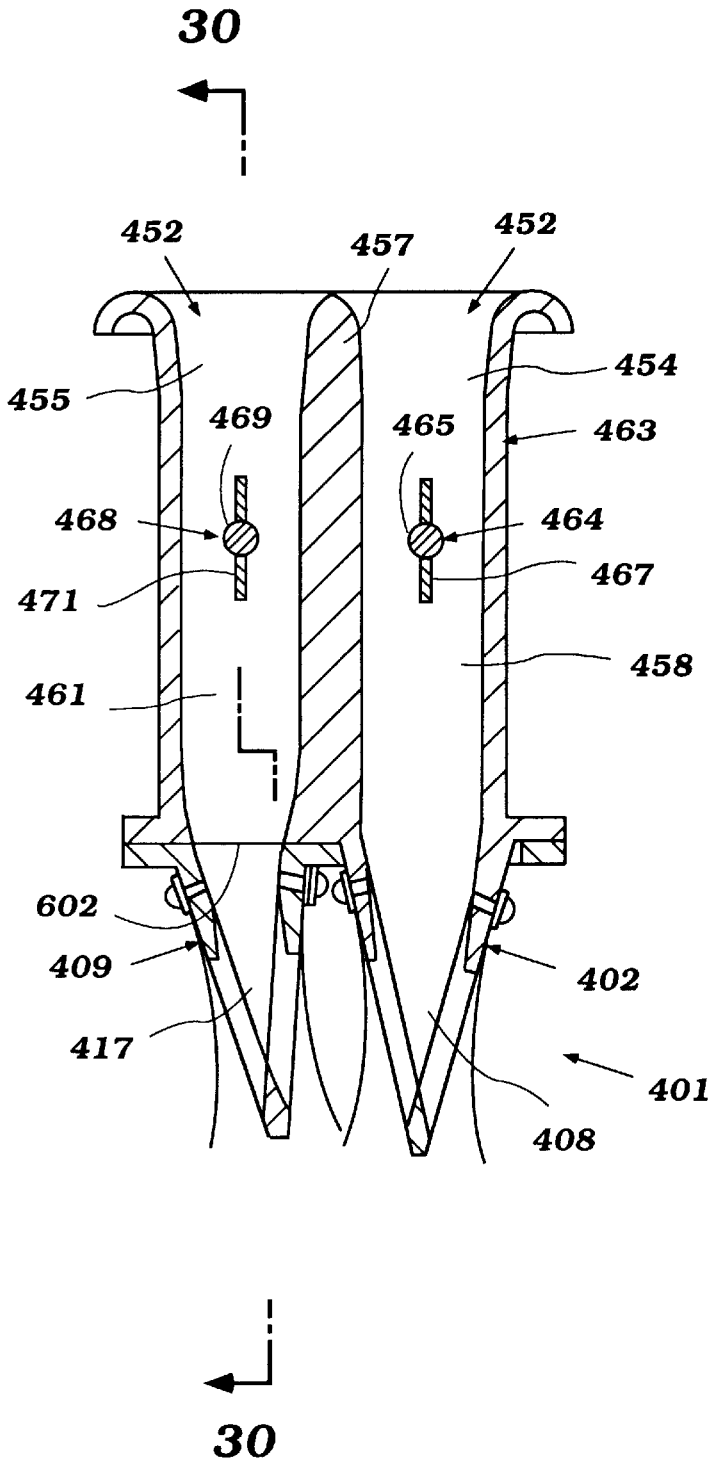
FIG. 29 is a cross-sectional view, in part similar to FIGS. 17, 20, 23, 25 and 27, and shows another embodiment of the invention.
Figure 30:
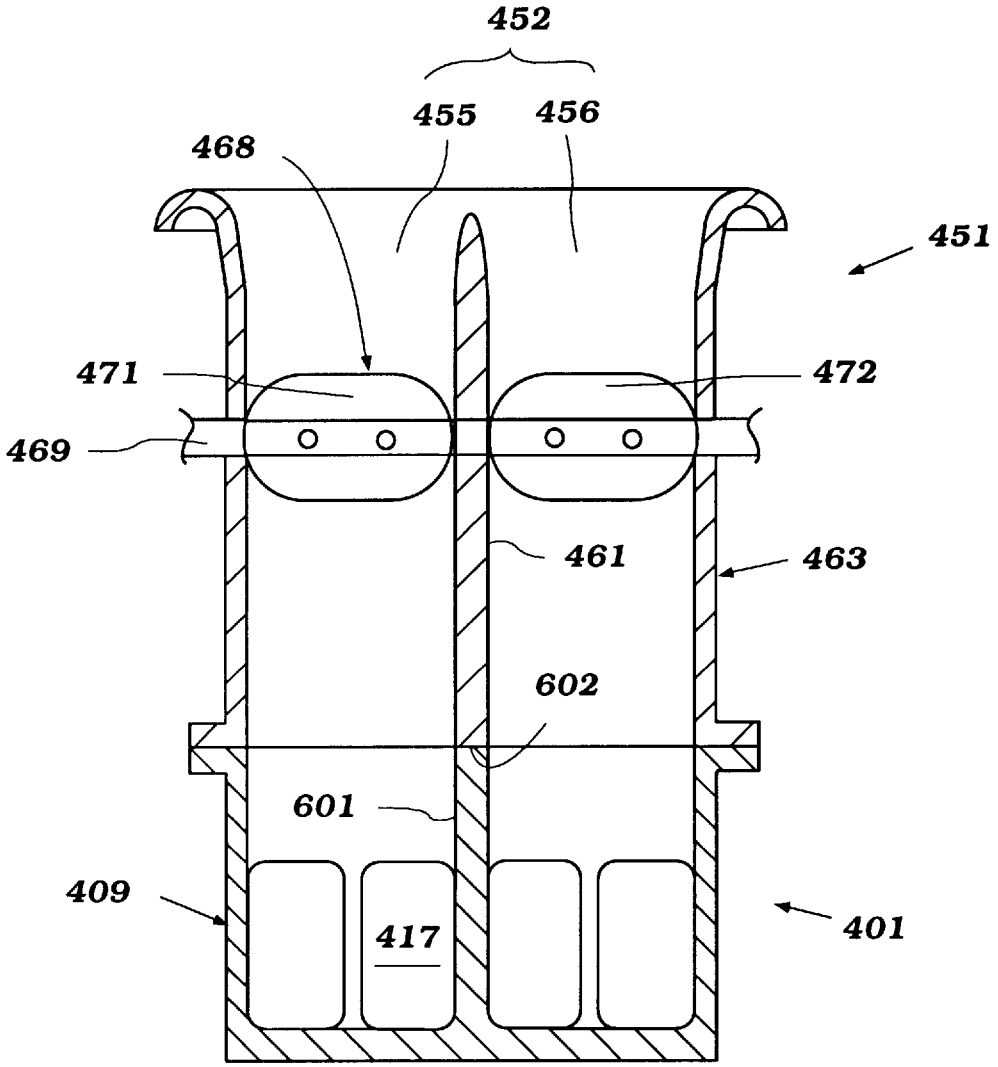
FIG. 30 is a cross-sectional view taken along the line 30—30 of FIG. 29.

FIGS. 29 and 30 show another embodiment of the invention wherein all four quadrants of the induction system are isolated from each other so as to permit a greater range of stratification or variation in fuel/air control. This embodiment is like the embodiment of FIGS. 20–22 and for that reason components of this embodiment which are the same as that embodiment have been identified by the same reference numerals. In this embodiment, each caging member 402 and 409 is provided with a respective internal wall 601 which is engaged by the lower edge 602 of the dividing wall 461 (FIG. 30) of the side passages 455 and 456 so that there will be complete isolation between the four quadrants of the reed valve assembly 401, as aforenoted.

Figure 31:
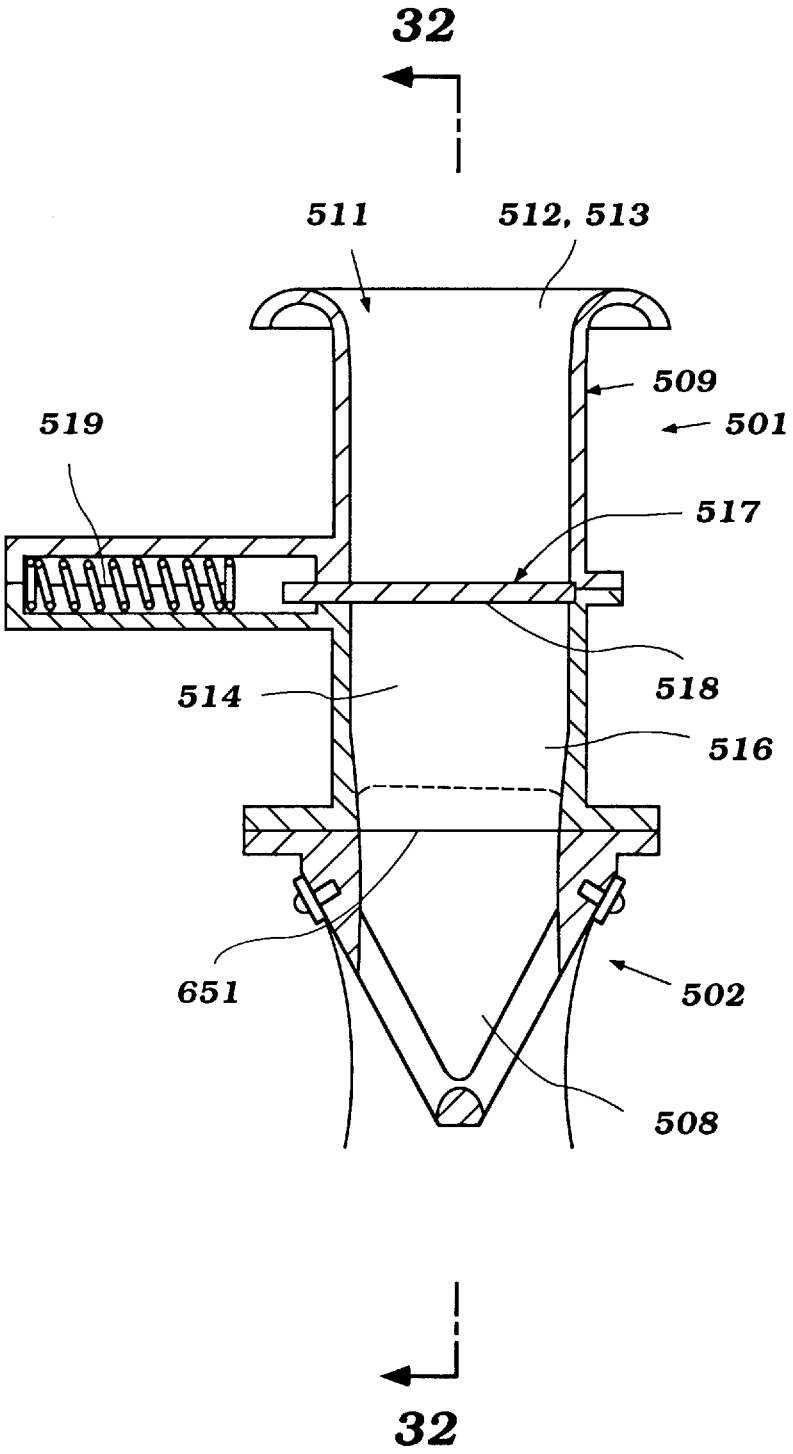
FIG. 31 is a cross-sectional view, in part similar to FIGS. 17, 20, 23, 25, 27 and 29, and shows still another embodiment of the invention.
Figure 32:
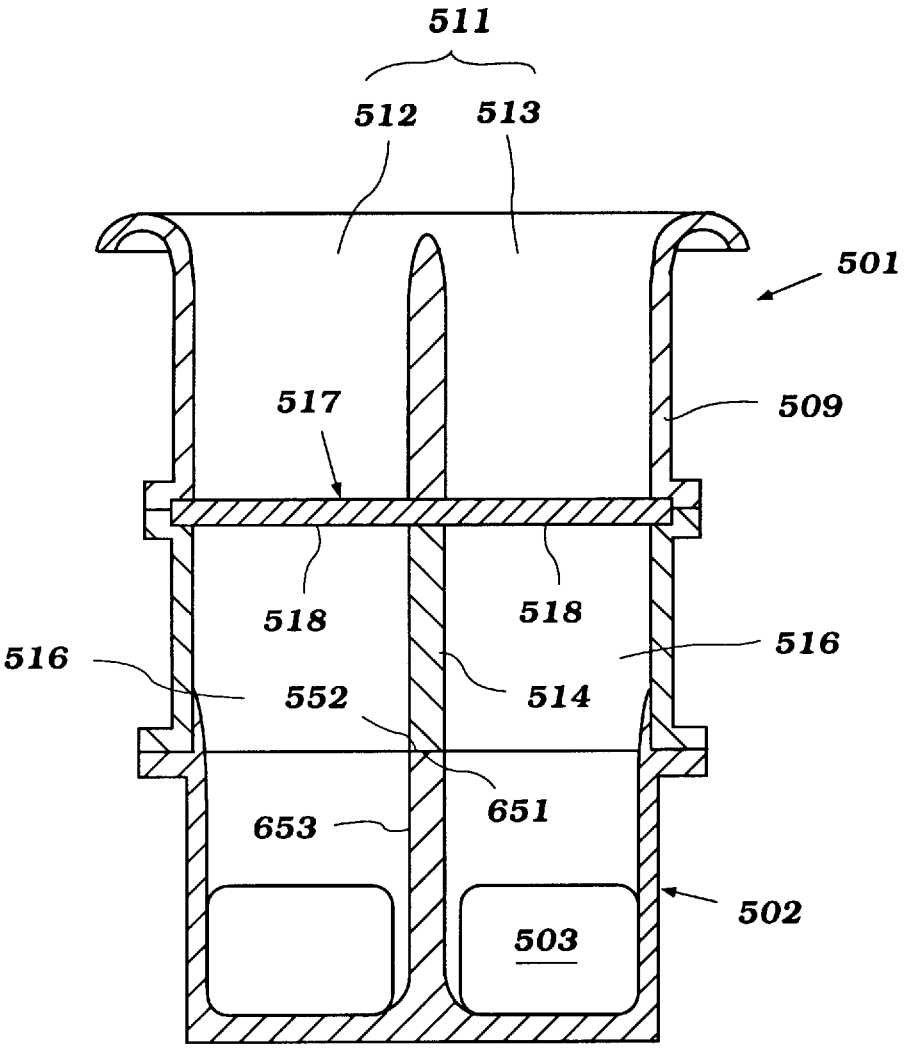
FIG. 32 is a cross-sectional view taken along the line 32—32 of FIG. 31.
Figure 33:
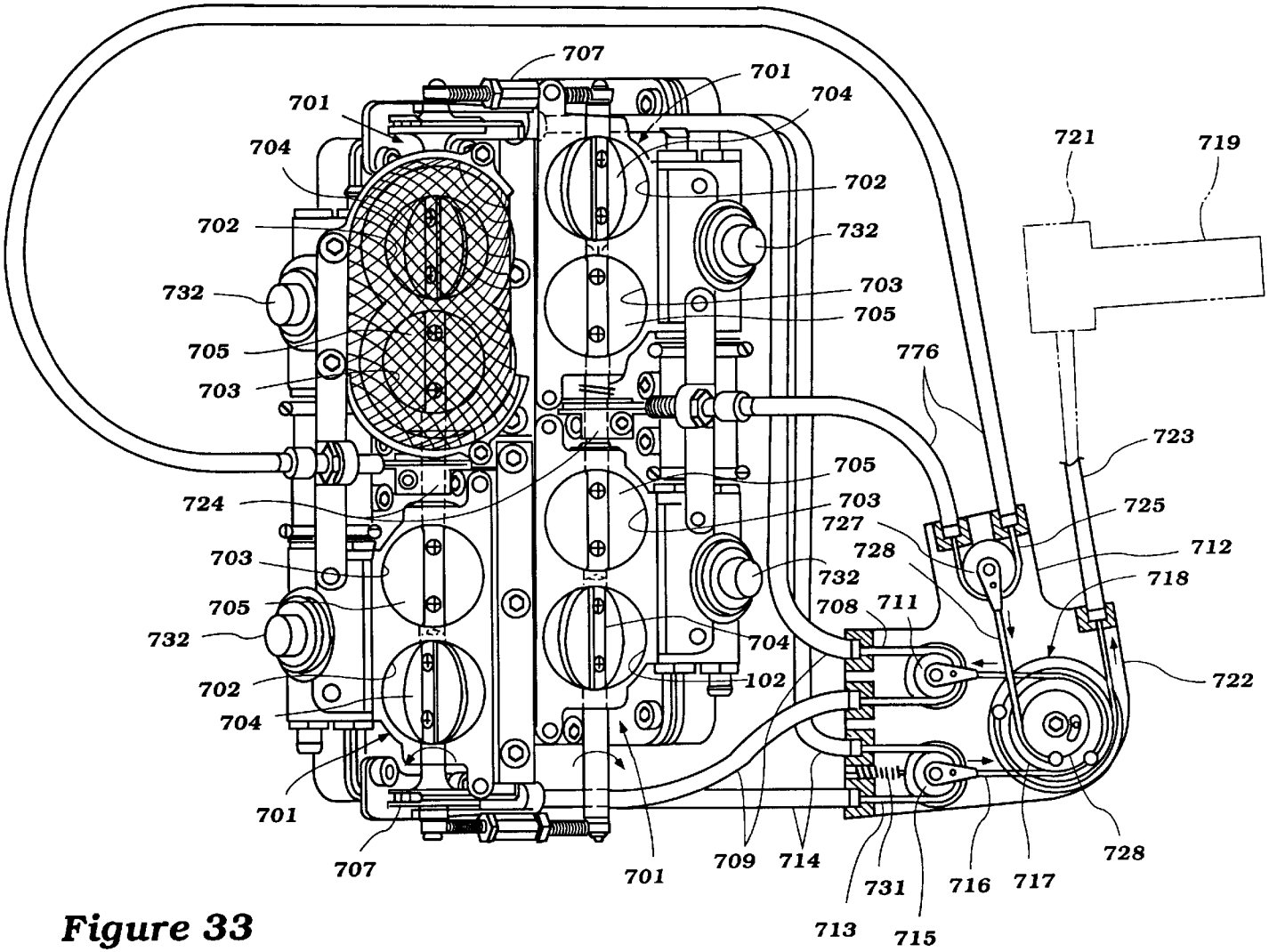
FIG. 33 is a view, in part similar to FIG. 3, and shows certain of the removed components in place and also shows the relationship of the throttle mechanism and remote throttle control in accordance with an embodiment of throttle control system.
Figure 34:
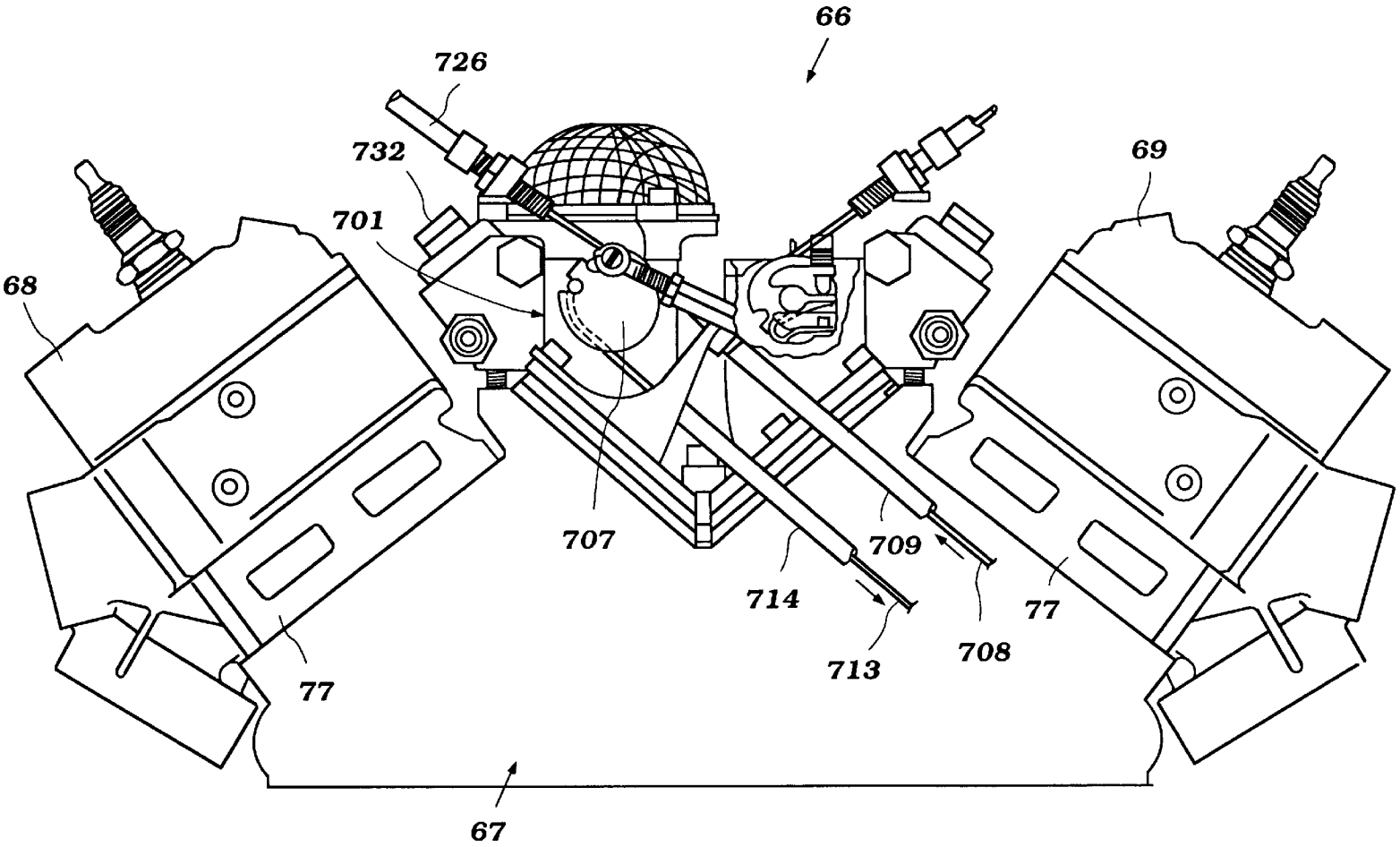
FIG. 34 is a view looking perpendicularly to the view of FIG. 33.

FIGS. 31 and 32 show a slide valve assembly, similar to the embodiment of FIGS. 23 and 24, however, in this embodiment there is complete isolation from side-to-side of the chamber 508 of the reed valve assembly 502. Because this is the only difference from the embodiment of FIGS. 23 and 24, components which are the same or substantially the same have been identified by the same reference numerals and will be described again only insofar as is necessary to understand the construction and operation of this embodiment.

In this embodiment, the dividing wall 519 between the intake passages 512 extends downwardly to a lower edge 651 which engages an upper edge 652 of a dividing wall 653 formed in the valving chamber 503 so as to divide it into left and right hand sides as clearly seen in FIG. 32. As a result, as the throttle valve moves open, the flow on these sides will be separated so as to afford stratification.

As has been previously noted in discussing certain of the embodiments, there may be times when it is desirable to provide different amounts of flow through the various caging areas of the reed type check valves. This can be done either to promote stratification in the combustion chamber or, alternatively, to promote turbulence and better mixing in the crankcase chambers. When this is done, a form of staged throttle valve arrangement is desirable and some embodiments of achieving such a staged operation will now be described.

Figure 3:
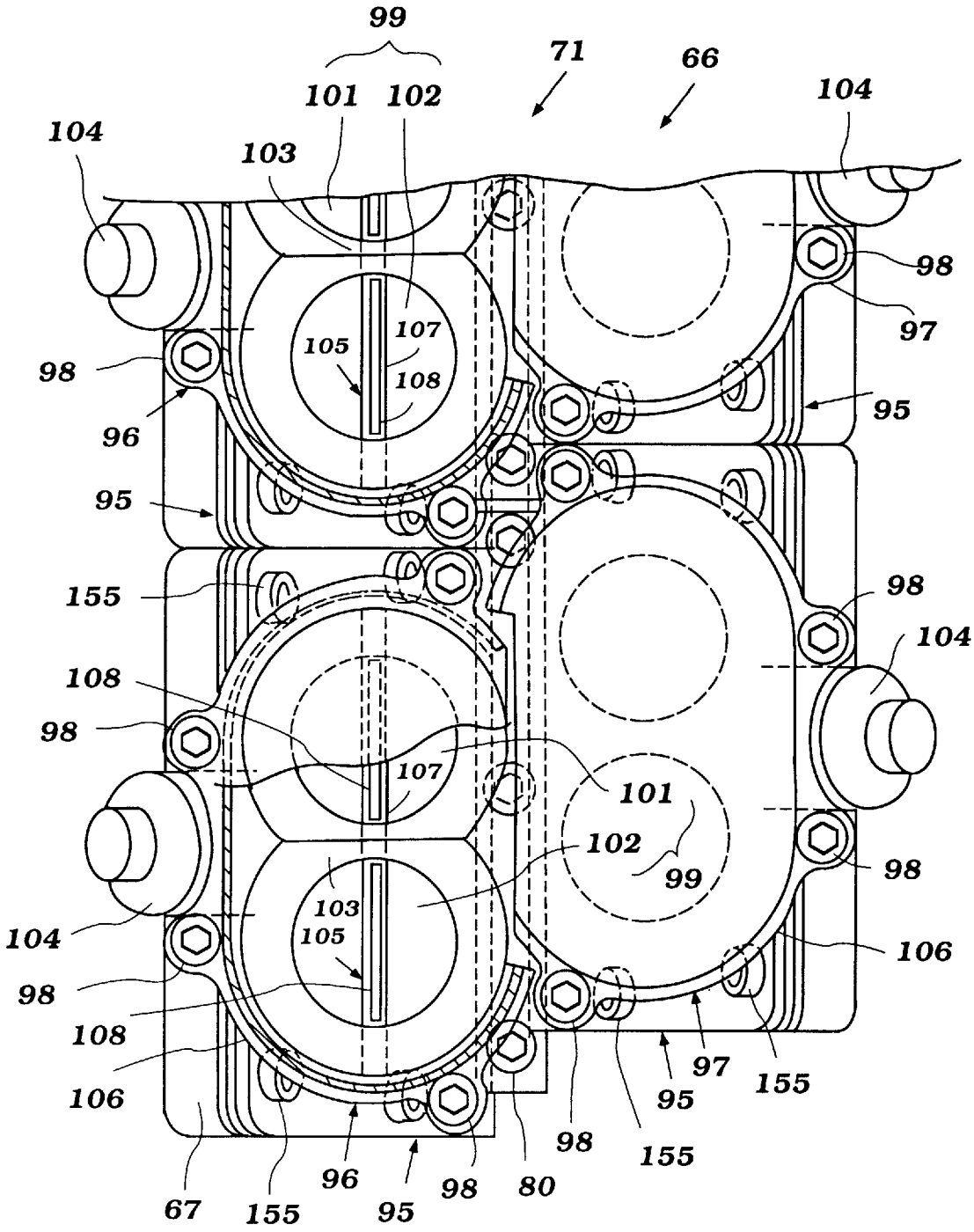
FIG. 3 is a view looking in the direction of the arrow 3—3 in FIG. 2, with certain portions broken away so as to more clearly show the construction.
Figure 4:
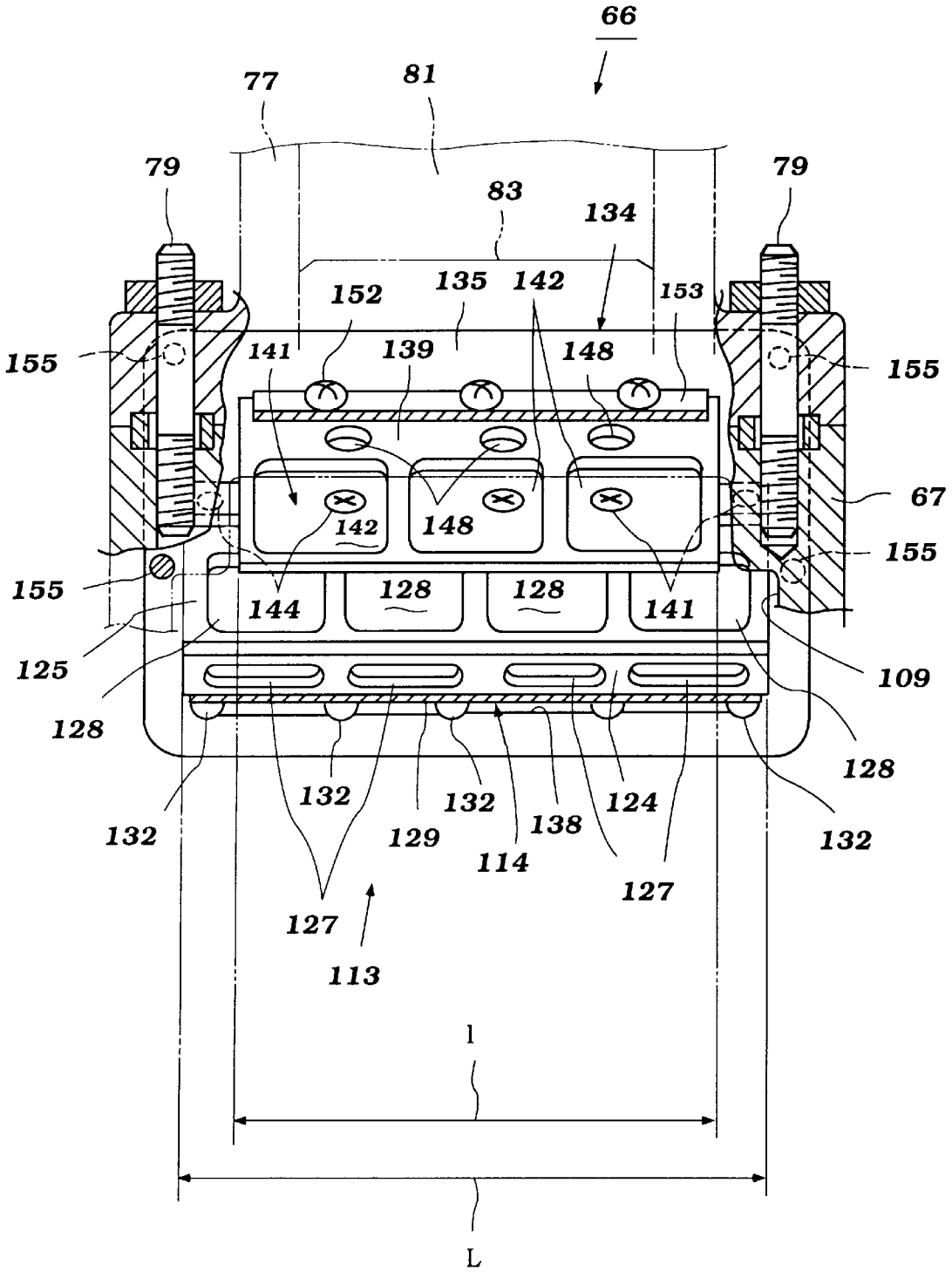
FIG. 4 is a cross-sectional view taken along the line 4—4 of FIG. 2 and shows the reed valve arrangement.
Figure 5:
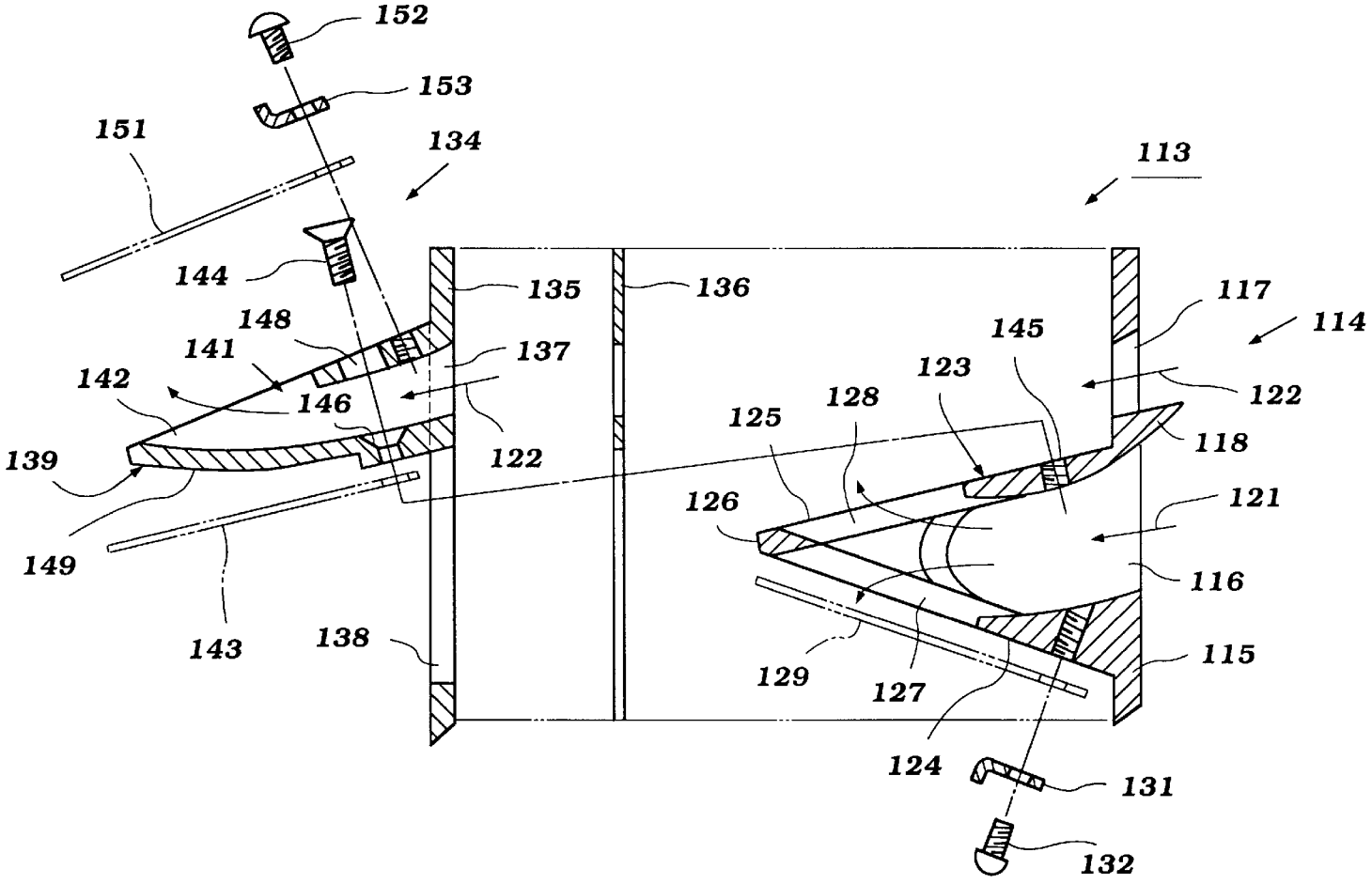
FIG. 5 is a partially exploded cross-sectional view of the reed valve arrangement.
Figure 6:
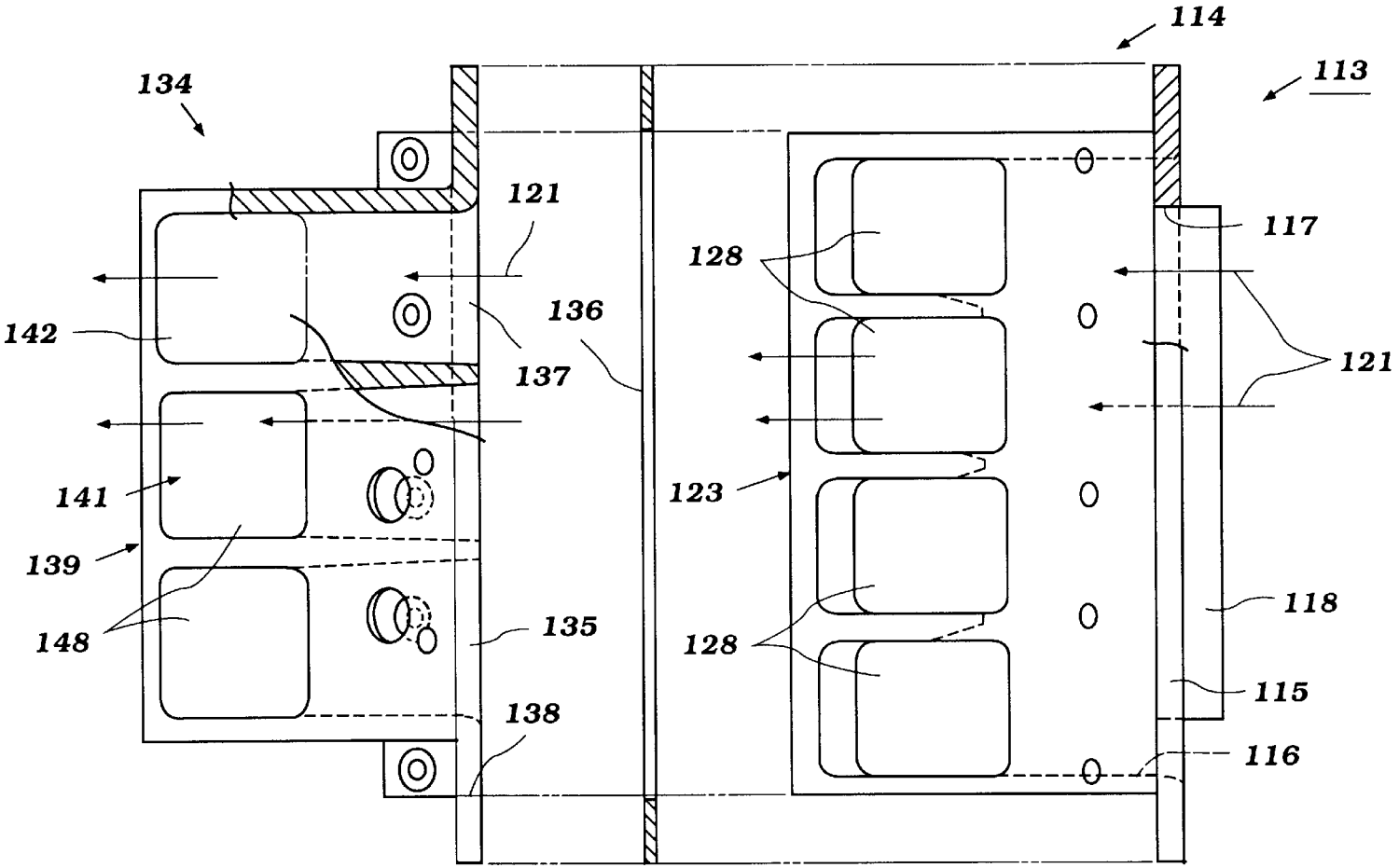
FIG. 6 is a top plan view of the construction as shown in FIG. 5.

Referring first to the embodiment of FIGS. 33–43, FIG. 33 is a view which is in part similar to FIG. 3 and shows the manifold arrangements associated with each of the four cylinders and combustion chambers. In this embodiment, each intake manifold is identified generally by the reference numeral 701 and is formed with a primary induction passage 702 and a secondary induction passage 703. The passages 702 and 703 may cooperate with any of the type of reed valve assemblies previously described and, in this particular embodiment, these reed valve assemblies may be of the type shown in FIGS. 1–6.

A primary throttle valve 704 is disposed in the primary intake passage 702 and a secondary throttle valve 705 is provided in the secondary intake passage 703. The throttle valves 704 and 705 are affixed to respective throttle valve shafts. It should be noted that the secondary intake passages 703 of adjacent intake manifolds 701 are disposed immediately adjacent to each other and the throttle valve shafts associated with the secondary throttle valve 705 may be fixed for rotation with each other.

The primary throttle valves 704 and their individual throttle valve shafts are disposed at opposite ends. However, the primary throttle valves 704 of one cylinder bank have their shafts interconnected for simultaneous movement with the primary throttle valves of the other cylinder bank through a connecting linkage 706. Pulleys 707 are affixed to the exposed ends of the primary throttle valve shafts of one cylinder bank and receive respective ends of wire actuators 708 that are contained within respective protective sheaths 709. The intermediate portion of the wire actuators 708 are received on a pulley 711 that is mounted on a mounting bracket 712 affixed suitably to the engine. A second wire actuator 713 is also affixed to the pulleys 704 and is encircled by a respective wire actuator 714. An intermediate portion of the wire actuator 713 is received over a further pulley 715. The pulleys 711 and 715 are, in turn, connected to the ends of a further wire actuator 716 which is wound around a first outer sheath 717 of a compound pulley 718 which is rotatably journaled on the mounting plate 712.

The pulley 718 is operated by a remotely positioned hand twist throttle grip 719 which operates a pulley 721 and wire actuators 722 contained within sheaths 723 so as to rotate the pulley 718 and, accordingly, cause the pulleys 715 and 711 to move relative to each other. As is well known in this art, a wire actuator is effective in transmitting a pulling force but not effective in transmitting a pushing force. Hence, rotation of the handle grip 719 in one direction will cause the pulley 715 to move toward the pulley 718 and effect opening of the primary throttle valves 704 as shown in the figures while rotation in the opposite direction will cause the pulley 711 to be drawn and move the primary throttle valves 704 to their closed positions.

Pulleys 724 are affixed to the interlinked throttle valve shafts of the secondary throttle valve 705 and are connected to opposite ends of a further wire actuator 725 which is contained within protective sheath 726. The intermediate portion of the wire actuator 725 is wrapped around a further pulley 727 which is carried by one end of a control wire 728 that is also connected to the throttle operated pulley 718 and more specifically to a smaller diameter inner groove 729 thereof. It should be noted that the throttle opening pulley 715 for the primary throttle valve 704 is mounted on a torsional spring 731 to maintain tension in the system.

In this embodiment, a fuel injector, indicated by the reference numeral 732, is provided for each intake manifold 701 and is disposed so as to spray fuel evenly to each of the induction passages 703 and 704. Since the fuel supply is identical to each of the primary and secondary induction passages 702 and 703, the air/fuel ratio will vary depending upon the position of the primary and secondary throttle valves 704 and 705. The construction is such that the primary throttle valves 704 be will open first and will open at a more rapid rate than the secondary throttle valves 705. As a result, the primary induction passages will supply an initially leaner fuel/air mixture than the secondary induction passages 703. The differences in air flow will cause turbulence in the crankcase chambers so as to cause good mixing.

Since the throttle operated pulley 718 has its outer sheath or groove 717 connected to the primary throttle actuating wire 716 while the inner pulley groove 729 is connected to the secondary throttle valve actuating wire 728, a given degree of pivotal movement of the throttle grip 719 will cause a greater movement of the primary throttle actuating wire 716 than the secondary throttle actuating wire 727. As a result, the primary throttle valves will open at a more rapid rate than the secondary throttle valves and this operation may now be understood best by reference to FIGS. 35–42.

Figure 35:
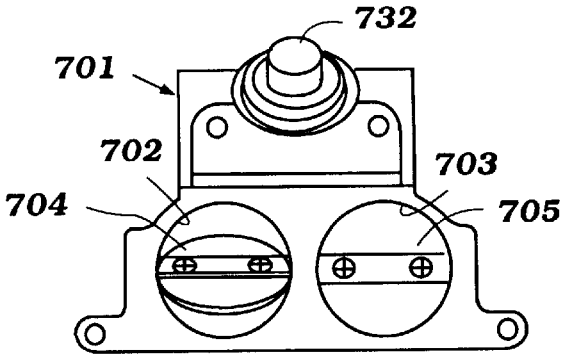
FIGS. 35–38 are views, in part similar to FIG. 33, and show the opening of the staged throttle valves from an idle to a full throttle range, respectively.
Figure 39:
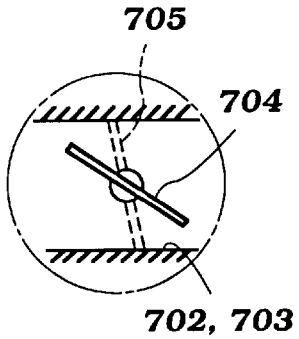
FIGS. 39–42 are cross-sectional views looking perpendicular to FIGS. 36–38 and show the respective throttle valve positions.
Figure 36:
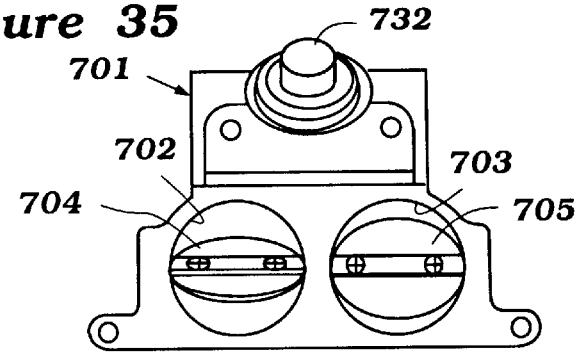
Figure 40:
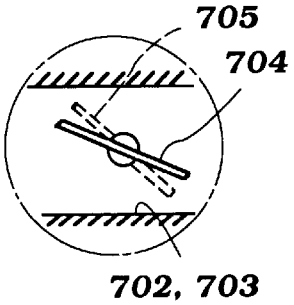
Figure 37:
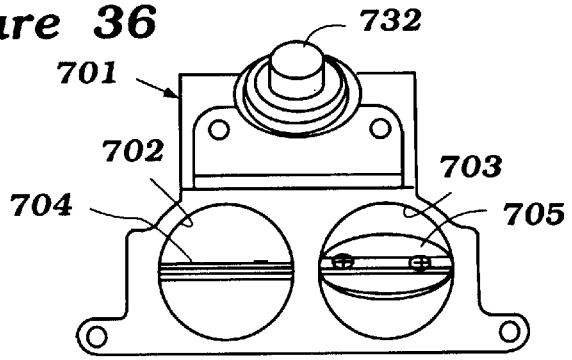
Figure 41:
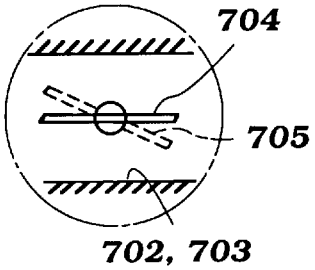
Figure 38:
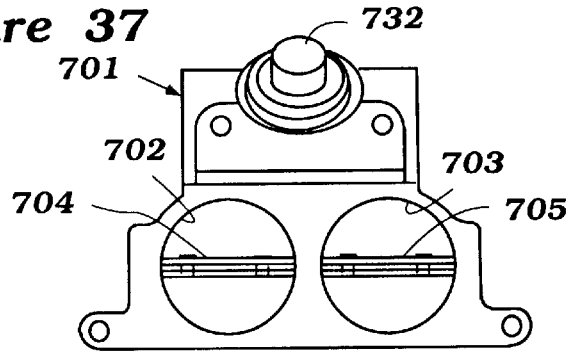
Figure 42:
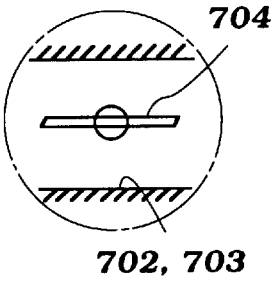

FIGS. 35 and 39 show the initial idle condition wherein the secondary throttle valves 705 are substantially closed while the primary throttle valves 704 are partially open. At this stage, a richer fuel/air mixture will be delivered through the secondary passage 703 than through the primary induction passage 702. As the twist throttle grip 719 is rotated in an opening direction, the primary throttle valve 704 will open more rapidly than the secondary throttle valve 705 as seen in FIGS. 36 and 40 and 37 and 41. Thus, the primary throttle valve 704 reaches its fully open position before the secondary throttle valve 705. This condition is shown in FIGS. 37 and 41. At this time, a stop (not shown) holds the primary throttle valves 704 in their open position. Upon continued twisting of the throttle grip 719, the secondary throttle valves 705 will then move to their fully open position as shown in FIGS. 38 and 42.

Figure 43:
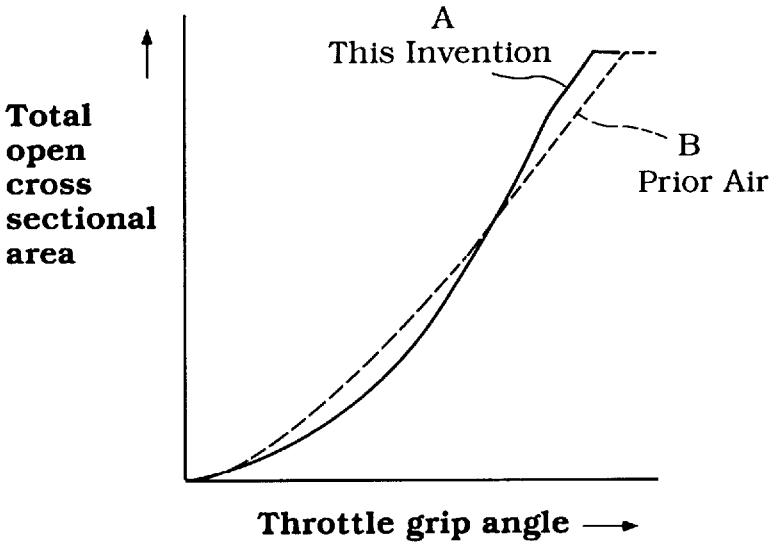
FIG. 43 is a graphical view showing the relationship of throttle grip or throttle control position angle and total effective cross-sectional flow area of the induction system.

The effect of this may be seen in FIG. 43 wherein the total opening cross-sectional area of the induction passages 702 and 703 combined in response to a given throttle angle of the rotation of the throttle grip 719 is shown by the solid line curve A as compared to the conventional operating structure as shown by the broken line curve B. It will be seen that at small throttle angle rotations, the change in flow area is less severe than with the conventional system and, therefore, the disclosed system is not as sensitive to small variations in throttle grip position at low speeds. However, as the throttle grip is moved toward its fully wide open position, the change in cross-sectional area increases to provide more rapid acceleration. Thus, the device provides not only good fuel mixing but also very good throttle control.

Figure 44:
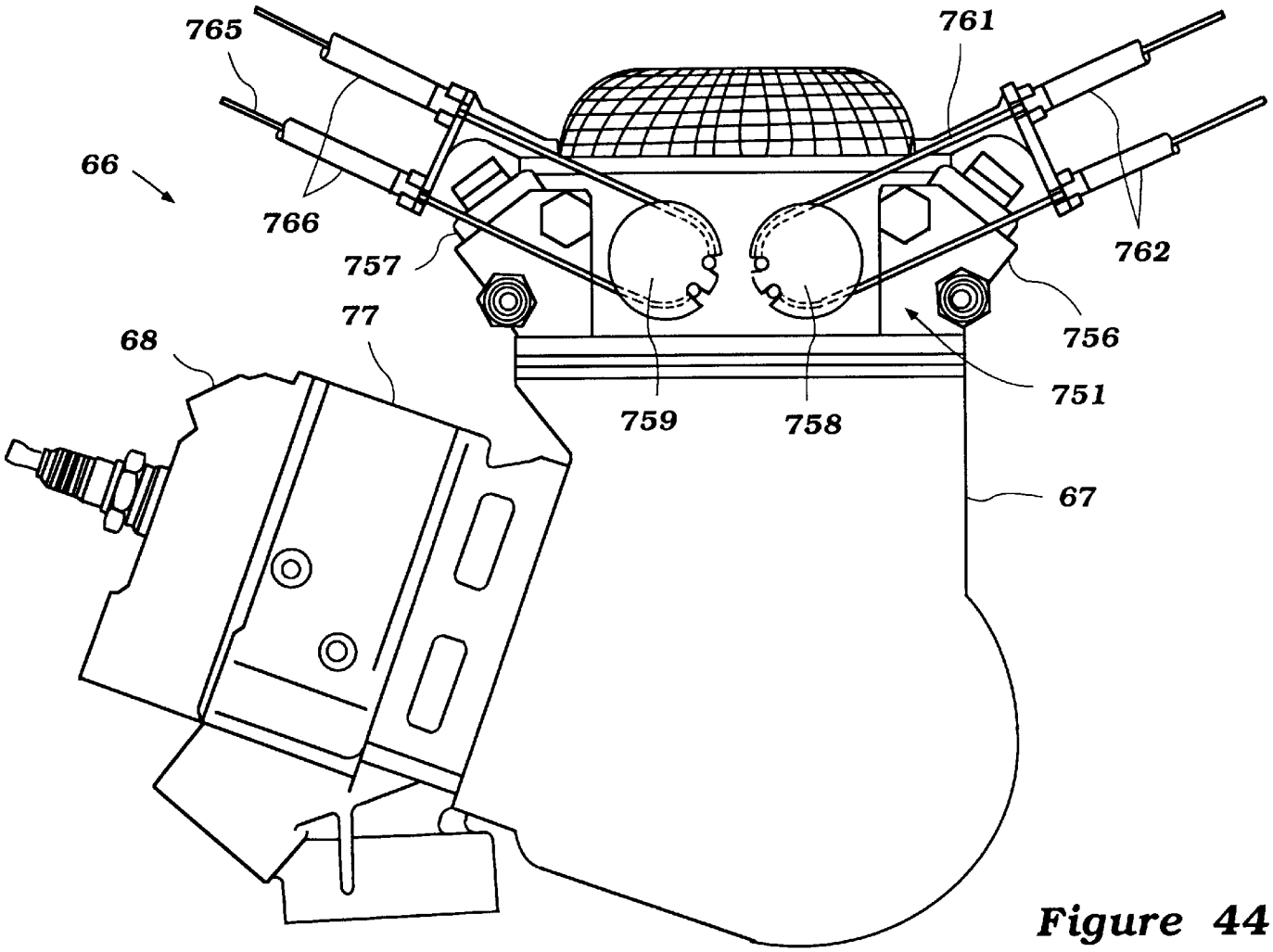
FIG. 44 is an end elevational view, in part similar to FIG. 34, showing another form of throttle valve control mechanism.
Figure 45:
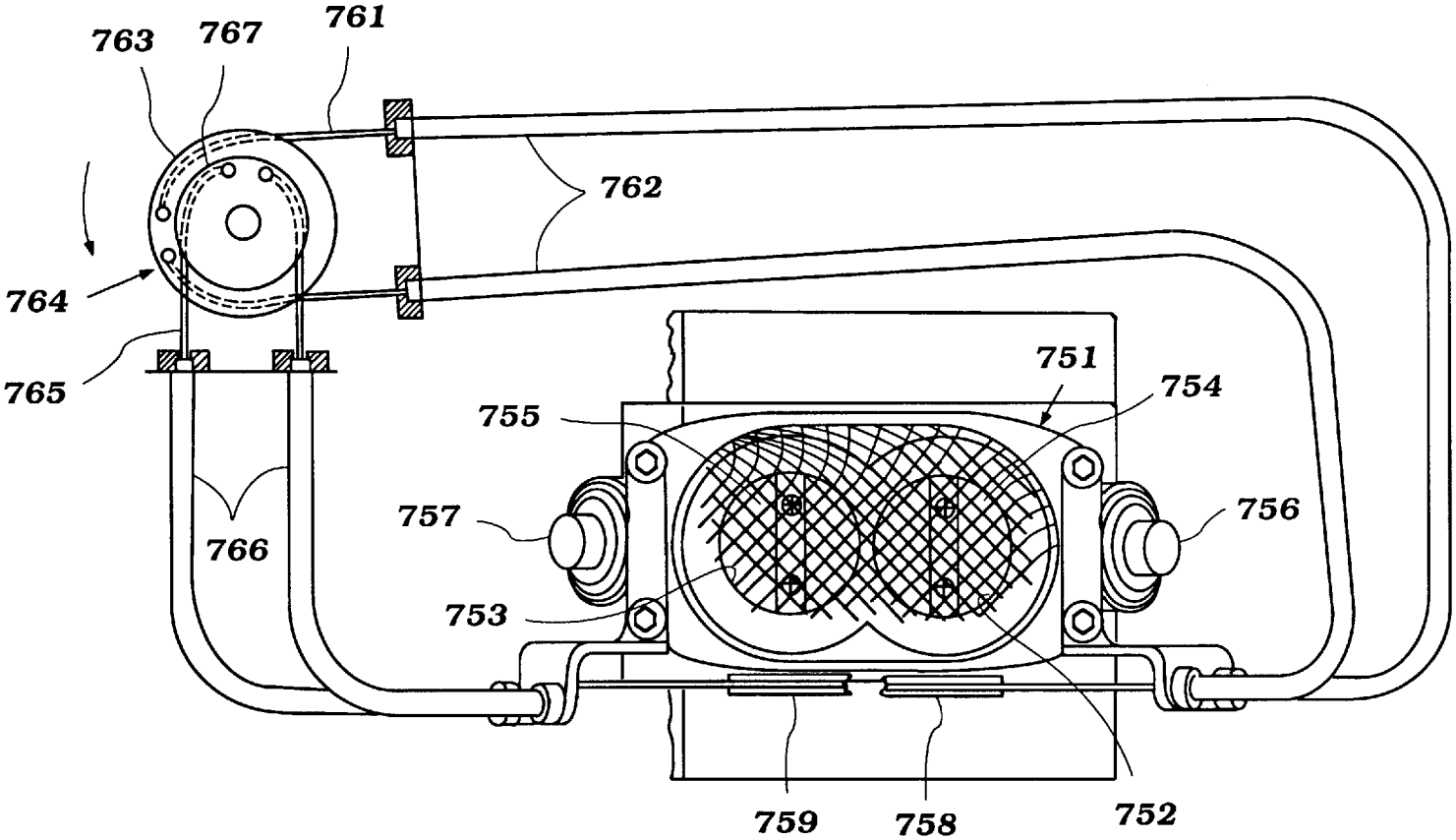
FIG. 45 is an end elevational view, in part similar to FIG. 33, for the embodiment of FIG. 44.

The throttle valve arrangement as thus far described in conjunction with FIGS. 33–43 can be employed with intake manifold and valving arrangements having a layout in accordance with the embodiment of FIGS. 1–6, 7 and 8, 9 and 10, 11, 12 and 13, 14–19, 25 and 26, and 27 and 28. FIGS. 44 and 45 show a throttle valve control arrangement that can be employed with manifold reed valve assemblies and throttle valve arrangements as shown in the embodiments of FIGS. 20–22 and 29 and 30 wherein each caged chamber is controlled by a separate throttle valve.

Referring now specifically to FIGS. 44 and 45, the manifold in this embodiment is identified by the reference numeral 751 and is provided with a primary induction passage 752 and a secondary induction passage 753, each of which communicates with a respective chamber of a reed valve assembly of the type shown in FIGS. 20–22 or 29 and 30. A primary throttle valve 754 controls the flow through the primary induction passage 752 and a secondary throttle valve 755 controls the flow through the secondary induction passage 753.

Primary and secondary fuel injectors 756 and 757 discharge into the primary and secondary induction passages 752 and 753, respectively. The primary throttle valve shaft has affixed to it a first pulley 758 and the secondary throttle valve shaft has affixed to it a secondary pulley 759. The primary pulley 758 is operated by means of a first wire actuator 761 contained within a protective sheath 762 and having its ends affixed in a groove 763 of a compound pulley 764.

A secondary control wire 765 has its ends affixed to the pulley 759 and is covered within a protective sheath 766. The ends of the wire actuator 765 are connected to a smaller diameter sheath 767 of the compound pulley 764. Thus, like the previously described embodiment, this embodiment operates so as to cause the primary throttle valves 754 to be opened more rapidly than the secondary throttle valve 755 so as to provide the same results as aforenoted.

Figure 46:
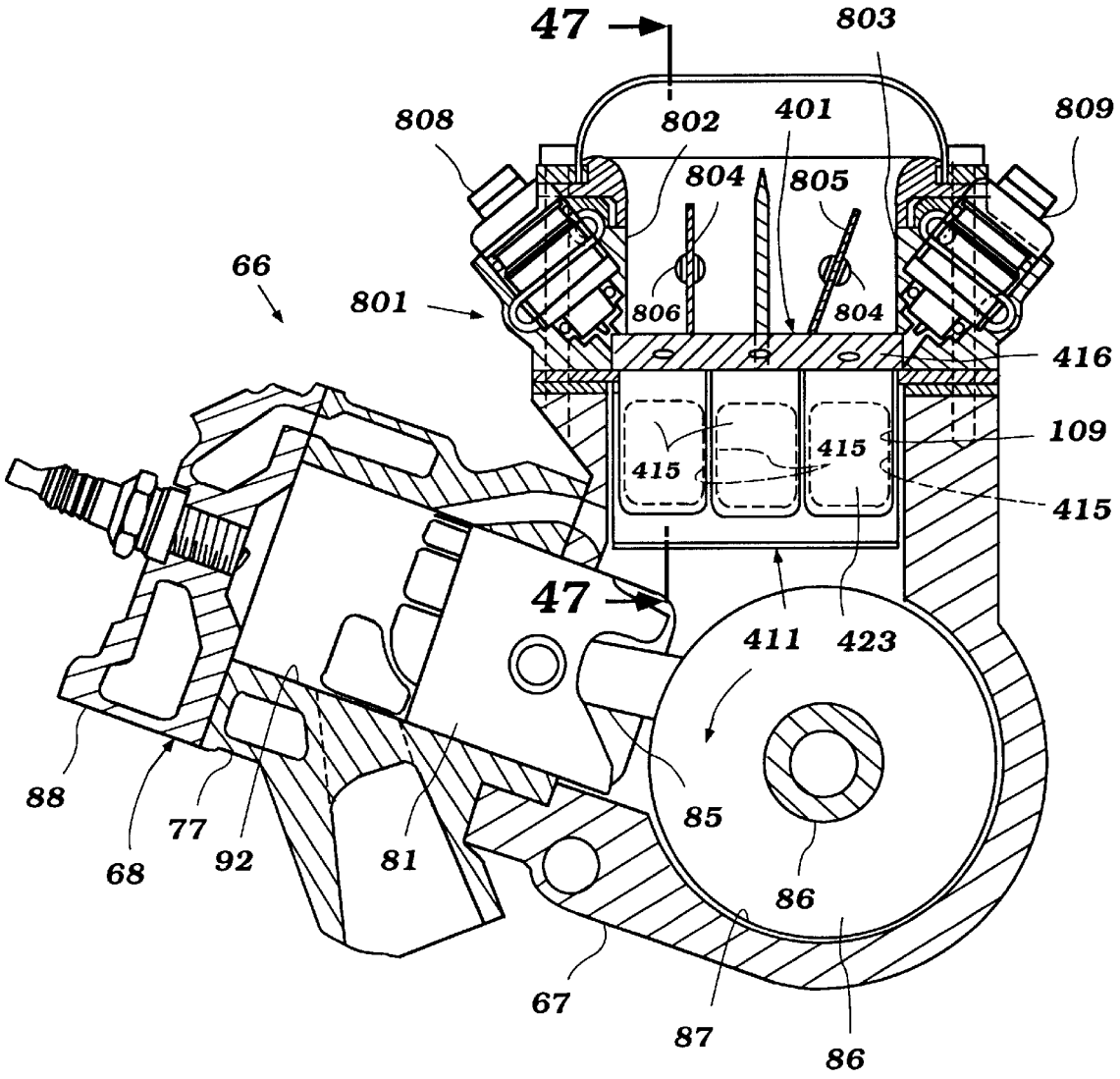
FIG. 46 is a cross-sectional view taken through a cylinder of an engine constructed in accordance with another embodiment of the invention and is in part similar to FIGS. 2, 7, and 9.
Figure 47:
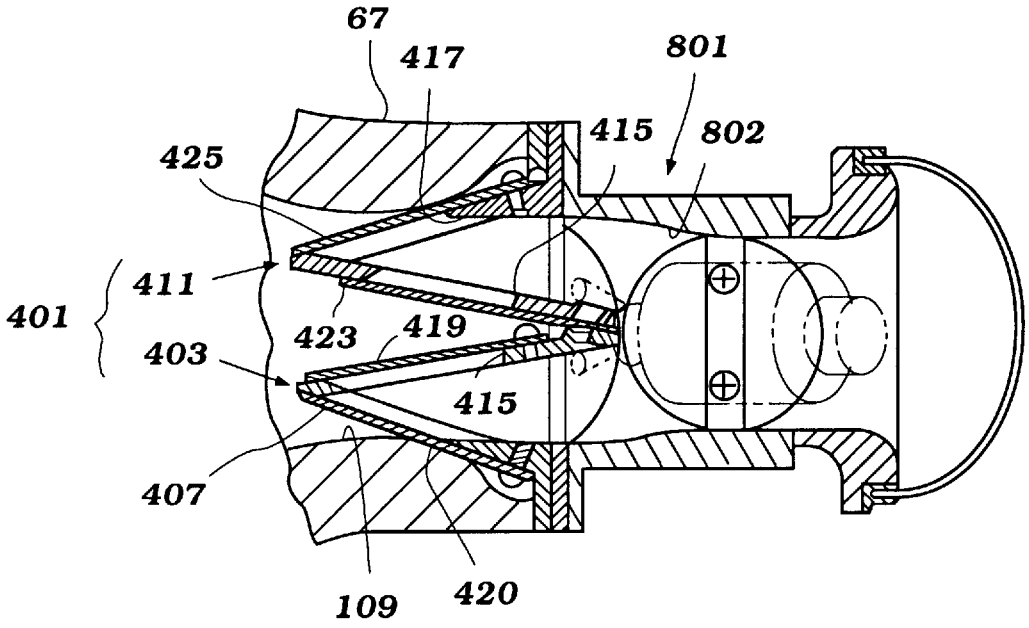
FIG. 47 is a cross-sectional view taken along the line 47—47 of FIG. 46.

In all of the embodiments of the invention as thus far described, the throttle valve shafts of the embodiments employing butterfly type throttle valves have rotated about axes that extend parallel to the intersecting bights of the caging members of the reed type valves. It is also possible to provide an arrangement wherein the throttle valve shafts rotate about an axis perpendicular to the bights of the caging members and FIGS. 46 and 47 show such an embodiment. In this embodiment, the reed type valve employed has a construction of the type shown in FIGS. 14–19 and, for that reason, the reed type valve and its components are identified by the same reference numerals as employed in that figure and other basic components of the engine which are the same have also been identified by these same reference numerals and will not be described again, except insofar as is necessary to understand the construction and operation of this embodiment.

An intake manifold 801 is provided that has a primary induction passage 802 and a secondary induction passage 803, which induction passages 802 and 803 are disposed so that they extend along the length of the caging members 411 and 403, respectively. A pair of butterfly type primary and secondary throttle valves 804 and 805 are supported on respective throttle valve shafts 806 and 807 that extend perpendicular to the apexes of the caging members 403 and 411. Primary and secondary fuel injectors 808 and 809 are mounted in the manifold 801 and are configured so that they spray through a pair of discharge channels 811 and 812, respectively, that are disposed on opposite sides of the dividing portion 416 of the reed type valve assembly. This insures that there will be equal flow to each caging member 403 and 411.

It should be readily apparent from the foregoing description that the described embodiments of the invention are very effective in providing a simple and yet highly effective reed type valve assemblies for internal combustion engines that permit a valving area that is equivalent to that of the intake area and which permits the use of a large number of reed type valving elements so as to insure rapid operation and effective sealing. In addition, the various throttling and valve constructions permit the desired degree of stratification and mixing in the crankcase chambers. Of course, the described embodiments are only those of preferred embodiments and various changes and modification may be made without departing from the spirit and scope of the invention, as defined by the appended claims.

I claim:

1. A reed type valve arrangement for a reciprocating machine having a passage serving a variable volume chamber of said machine, a mounting plate adapted to be affixed within said passage and having a flow passage extending therethrough, a first caging member formed integrally with said mounting plate and dividing said flow passage into a first portion terminating in a first valved opening and a second portion, a second caging member detachably affixed to said first caging member and in registry with said second portion of said flow passage, said second caging member forming a second valved opening in communication with said second portion of said flow passage, at least one of said caging members defining a third valved opening communicating with the respective portion of said flow passage, and means for affixing first, second and third reed valve elements across said first, second and third valved openings, respectively, for controlling the flow therethrough, the means for affixing one of said reed valve elements to its valved opening also constituting the means for affixing said second caging member to said first caging member.

2. A reed type valve arrangement as set forth in claim 1 wherein each of the valved openings comprise a plurality of valved openings and wherein the reed valves each control the flow through the respective openings.

3. A reed type valve arrangement as set forth in claim 2 wherein each of the reed valves has a plurality of fingers each controlling a respective valved opening and formed integrally with each other.

4. A reed type valve arrangement as set forth in claim 1 wherein the first caging member is formed with the third valved opening.

5. A reed type valve arrangement as set forth in claim 4 wherein the affixing means affixes the first reed valve to the first valved opening and passes through the second caging member and wherein the second reed valve closes the opening in the second caging member that passes the affixing means.

6. A reed type valve arrangement as set forth in claim 4 wherein the means for affixing the third reed valve to the third valved opening affixes the second caging member to the first caging member and wherein the affixing means comprises a plurality of threaded fasteners.

7. A reed type valve arrangement as set forth in claim 6 wherein the plurality of threaded fasteners extends through openings in the first caging member which openings are closed by threaded closure members.

8. A reed type valve arrangement as set forth in claim 1 wherein the third valved opening is formed in the first caging member and further including a fourth valved opening formed in the second caging member and means for affixing a fourth reed valving element to said second caging member.

9. A reed type valve arrangement as set forth in claim 1 wherein the reciprocating machine comprises an internal combustion engine.

10. A reed type valve arrangement as set forth in claim 9 wherein the engine operates on a two cycle crankcase compression principle.

11. A reed type valve arrangement as set forth in claim 10 wherein the passage comprises an induction passage for delivering a charge to the crankcase of the engine.

12. A reed type valve arrangement as set forth in claim 11 wherein the intake passage is served by a pair of induction passages extending upstream of the reed type valve.

13. A reed type valve arrangement for a two cycle crankcase compression internal combustion engine having a pair of induction passages serving the crankcase of said engine through said reed type valve arrangement, said reed type valve arrangement comprising a mounting plate adapted to be affixed within said passage and having a flow passage extending therethrough, a first caging member formed integrally with said mounting plate and dividing said pair of induction passages into a first portion terminating in a first valved opening and a second portion, a second caging member detachably affixed to said first caging member and in registry with said second portion of said induction passages, said second caging member forming a second valved opening in communication with said second portion of said induction passages, at least one of said caging member defining a third valve opening communicating with the respective portion of said induction passages, means for affixing said first, second and third reed valve elements across said first, second and third valved openings, respectively, for controlling the flow therethrough, said induction passages each being provided with a flow controlling throttle valve.

14. A reed type valve arrangement as set forth in claim 13 wherein the flow controlling throttle valves comprises at least a pair of valves and means for opening said valves in a staged fashion.

15. A reed type valve arrangement as set forth in claim 13 wherein each induction passage serves both of the portions of the flow passage.

16. A reed type valve arrangement as set forth in claim 15 wherein means are provided for opening the flow controlling throttle valves are opened in a staged fashion.

17. A reed type valve arrangement as set forth in claim 15 further including a dividing wall formed in each caging member for dividing the caging member into first and second portions each having a valved opening.

18. A reed type valve arrangement as set forth in claim 17 wherein means are provided for opening the flow controlling throttle valves in a staged fashion.

19. A reed type valve arrangement as set forth in claim 13 wherein each of the induction passages serves only a respective one of the flow passage portions.

20. A reed type valve arrangement as set forth in claim 19 wherein the flow controlling throttle valves are opened in a staged fashion.

21. A reed type valve arrangement as set forth in claim 13 further including a fuel injector for injecting fuel into the induction passages.

22. A reed type valve arrangement as set forth in claim 21 wherein there is provided a separate fuel injector for each induction passage.

23. A reed type valve arrangement as set forth in claim 22 wherein the fuel injectors inject in a direction perpendicular to the valved openings.

24. A reed type valve arrangement as set forth in claim 22 wherein the fuel injectors inject in a direction parallel to the valved openings.

25. A reed type valve arrangement as set forth in claim 21 wherein a single fuel injector injects fuel into both of the flow passage sections.

26. A reed type valve arrangement for a reciprocating machine having a passage serving a variable volume chamber of said machine, a mounting plate adapted to be affixed within said passage and having a flow passage extending therethrough, a first caging member formed integrally with said mounting plate and dividing said flow passage into a first portion terminating in a first valved opening and a second portion, a second caging member detachably affixed to said first caging member and in registry with said second portion of said flow passage, said second caging member forming a second valved opening in communication with said second portion of said flow passage, at least one of said caring members defining a third valved opening communicating with the respective portion of said flow passage, and means for affixing first, second and third reed valve elements across said first, second and third valved openings, respectively, for controlling the flow therethrough, each of said valved openings comprising a plurality of valved openings and wherein the caging member having the third valved opening has the same number of openings as its other valved opening and the remaining caging member has a lesser number of valved openings.

27. A reed type valve arrangement as set forth in claim 26 wherein the means for affixing the reed valves to the respective caging members are staggered.

28. A reed type valve arrangement as set forth in claim 27 wherein the at least one of the caging member, has four valved openings and the other caging member has three valved openings.

29. A reed type valve arrangement as set forth in claim 28 wherein the caging member having the three valved openings has another series of three valved openings controlled by a fourth reed valve element.

30. A reed type valve arrangement as set forth in claim 26 wherein the passage has a circular cross-sectional area.

31. A reed type valve arrangement as set forth in claim 30 wherein the valved openings have an effective cross-sectional flow area approximately equal to the cross-sectional flow area of the passage.

32. A reed type valve arrangement as set forth in claim 31 wherein the valved openings are rectangular.

33. A reed type valve arrangement as set forth in claim 32 wherein each of the valved openings comprise a plurality of valved openings and wherein the reed valves each control the flow through the respective openings.

34. A reed type valve arrangement as set forth in claim 33 wherein each of the reed valves has a plurality of fingers each controlling a respective valved opening and formed integrally with each other.

35. A reed type valve arrangement as set forth in claim 32 wherein the means for affixing at least one of the reed valve elements to its valved opening also affixes the second caging member to the first caging member.

36. A reed type valve arrangement as set forth in claim 35 wherein the first caging member is formed with the third valved opening.

37. A reed type valve arrangement as set forth in claim 36 wherein the affixing means affixes the first reed valve to the first valved opening and passes through the second caging member and wherein the second reed valve closes the opening in the second caging member that passes the threaded fasteners.

38. A reed type valve arrangement as set forth in claim 36 wherein the means for affixing the third reed valve to the third valved opening affixes the second caging member to the first caging member and wherein the means comprises a plurality of threaded fasteners.

39. A reed type valve arrangement as set forth in claim 38 wherein the plurality of threaded fasteners extends through openings in the first caging member which openings are closed by further threaded closure members.

40. A reed type valve arrangement as set forth in claim 32 wherein the third valved opening is formed in the first caging member and further including a fourth valved opening formed in the second caging member and means for affixing a fourth reed valving element to said second caging member.

41. A reed type valve arrangement as set forth in claim 40 wherein the means for affixing the reed valves to the respective caging members are staggered.

42. A reed type valve arrangement as set forth in claim 41 wherein the at least one of the caging members has four openings and the other caging member having the single valved opening has three valved openings.

43. A reed type valve arrangement as set forth in claim 42 wherein the caging member having the three valved openings has another series of three valved openings controlled by a fourth reed valve member.

44. A reed valve arrangement for a reciprocating machine having a passage serving a variable volume chamber of said machine, a mounting plate adapted to be affixed within said passage and having a flow passage extending therethrough, a first caging member formed integrally with said mounting plate and dividing said flow passage into a first portion terminating in a first valved opening and a second portion, a second caging member detachably affixed to said first caging member and in registry with said second portion of said flow passage, said second caging member forming a second valved opening in communication with said second portion of said flow passage, at least one of said caging members defining a third valved opening communicating with the respective portion of said flow passage, and means for affixing first, second and third reed valve elements across said first, second and third valved openings, respectively, for controlling the flow therethrough, said passage comprising a pair of generally circular cross-sectional passages communicating with said caging members.

45. A reed type valve arrangement as set forth in claim 44 wherein the valved openings have an effective cross-sectional flow area approximately equal to the cross-sectional flow area of the circular cross-sectional passages.

46. A reed type valve arrangement as set forth in claim 44 wherein the valved openings are rectangular.

47. A reed type valve arrangement as set forth in claim 46 wherein each of the valved openings comprise a plurality of valved openings and wherein the reed valves each control the flow through the respective openings.

48. A reed type valve arrangement as set forth in claim 47 wherein each of the reed valves has a plurality of fingers each controlling a respective valved opening and formed integrally with each other.

49. A reed type valve arrangement as set forth in claim 46 wherein the means for affixing at least one of the reed valve elements to its valved opening also affixes the second caging member to the first caging member.

50. A reed type valve arrangement as set forth in claim 49 wherein the first caging member is formed with the third valved opening.

51. A reed type valve arrangement as set forth in claim 50 wherein the affixing means affixes the first reed valve to the first valved opening and passes through the second caging member and wherein the second reed valve closes the opening in the second caging member that passes the threaded fasteners.

52. A reed type valve arrangement as set forth in claim 50 wherein the means for affixing the third reed valve to the third valved opening affixes the second caging member to the first caging member and wherein the means comprises a plurality of threaded fasteners.

53. A reed type valve arrangement as set forth in claim 48 wherein each of the valved openings comprises a plurality of valved openings and wherein the caging member having the third valved opening has the same number of openings for the third valved opening as its other valved opening and the remaining caging member has a lesser number of valved openings.

54. A reed type valve arrangement as set forth in claim 53 wherein the means for affixing the reed valves to the respective caging members are staggered.

55. A reed type valve arrangement as set forth in claim 54 wherein the at least one of the caging member has four valved openings and the other caging member has three valved openings.

56. A reed type valve arrangement as set forth in claim 55 wherein the caging member having the three valved openings has another series of three valved openings controlled by a fourth reed valve member.

57. A reed type valve arrangement as set forth in claim 44 wherein the reciprocating machine comprises an internal combustion engine.

58. A reed type valve arrangement as set forth in claim 57 wherein the engine operates on a two cycle crankcase compression principle.

59. A reed type valve arrangement as set forth in claim 58 wherein the circular cross-sectional passages comprise induction passages for delivering a charge to the crankcase of the engine.

60. A reed type valve arrangement as set forth in claim 59 wherein the induction passages are each provided with a flow controlling throttle valve.

61. A reed type valve arrangement as set forth in claim 60 wherein the flow controlling throttle valves comprises at least a pair of valves and means for opening said valves in a staged fashion.

62. A reed type valve arrangement as set forth in claim 59 wherein each induction passage serves both of the portions of the flow passage.

63. A reed type valve arrangement as set forth in claim 58 wherein the flow controlling throttle valves are opened in a staged fashion.

64. A reed type valve arrangement as set forth in claim 62 wherein means are provided for opening the flow controlling throttle valves in a staged fashion.

65. A reed type valve arrangement as set forth in claim 62 further including a dividing wall formed in each caging member for dividing the caging member into first and second portions each having a valved opening.

66. A reed type valve arrangement as set forth in claim 65 wherein the induction passages are each provided with a flow controlling throttle valve.

67. A reed type valve arrangement as set forth in claim 66 wherein means are provided for opening the flow controlling throttle valves in a staged fashion.

68. A reed type valve arrangement as set forth in claim 59 wherein each of the induction passages serves only a respective one of the flow passage portions.

69. A reed type valve arrangement as set forth in claim 68 wherein the induction passages are each provided with a flow controlling throttle valve.

70. A reed type valve arrangement as set forth in claim 69 wherein means are provided for opening the flow controlling throttle valves in a staged fashion.

71. A reed type valve arrangement as set forth in claim 59 further including a fuel injector for injecting fuel into the induction passages.

72. A reed type valve arrangement as set forth in claim 71 wherein there is provided a separate fuel injector for each induction passage.

73. A reed type valve arrangement as set forth in claim 72 wherein the fuel injectors inject in a direction perpendicular to the valved openings.

74. A reed type valve arrangement as set forth in claim 72 wherein the fuel injectors inject in a direction parallel to the valved openings.

75. A reed type valve arrangement as set forth in claim 71 wherein a single fuel injector injects fuel into both of the flow passage sections.

76. A reed valve arrangement for a reciprocating machine comprising a caging member defining a flow chamber, at least a pair of angular related portions each defining at least one generally rectangular configured valved opening communicating with said flow chamber, said valved openings communicating with a common variable volume chamber of said machine, reed valve means for controlling the flow through said valved openings, and a pair of generally circular cross-sectional flow passages communicating with said flow chamber.

77. A reed valve arrangement as set forth in claim 76 wherein the effective cross-sectional area of the flow passages is substantially equal to that of the valved openings.

78. A reed type valve arrangement as set forth in claim 77 wherein each of the valved openings comprise a plurality of valved openings and wherein the reed valves each control the flow through the respective openings.

79. A reed type valve arrangement as set forth in claim 78 wherein each of the reed valves has a plurality of fingers each controlling a respective valved opening and formed integrally with each other.

80. A reed type valve arrangement as set forth in claim 79 wherein the reciprocating machine comprises an internal combustion engine.

81. A reed type valve arrangement as set forth in claim 80 wherein the engine operates on a two cycle crankcase compression principle.

82. A reed type valve arrangement as set forth in claim 81 wherein the passage comprises an induction passage for delivering a charge to the crankcase of the engine.

83. A reed type valve arrangement as set forth in claim 82 wherein the induction passages are each provided with a flow controlling throttle valve.

84. A reed type valve arrangement as set forth in claim 83 wherein the flow controlling throttle valve comprises at least a pair of valves opened in a staged fashion.

85. A reed type valve arrangement as set forth in claim 82 wherein each induction passage serves both of the portions of the flow passage.

86. A reed type valve arrangement as set forth in claim 85 wherein the induction passages are each provided with a flow controlling throttle valve.

87. A reed type valve arrangement as set forth in claim 86 wherein means are provided for opening the flow controlling throttle valves in a staged fashion.

88. A reed type valve arrangement as set forth in claim 82 further including a dividing wall formed in the caging member for dividing the caging member into first and second portions each having a valved opening.

89. A reed type valve arrangement as set forth in claim 88 wherein the induction passages are each provided with a flow controlling throttle valve.

90. A reed type valve arrangement as set forth in claim 89 wherein the flow controlling throttle valves are opened in a staged fashion.

91. A reed type valve arrangement as set forth in claim 82 wherein each of the induction passages serves only a respective one of the valved openings.

92. A reed type valve arrangement as set forth in claim 91 wherein the induction passages are each provided with a flow controlling throttle valve.

93. A reed type valve arrangement as set forth in claim 92 wherein means are provided for opening the flow controlling throttle valves in a staged fashion.

94. A reed type valve arrangement as set forth in claim 82 further including a fuel injector for injecting fuel into the induction passages.

95. A reed type valve arrangement as set forth in claim 94 wherein there is provided a separate fuel injector for each induction passage.

96. A reed type valve arrangement as set forth in claim 95 wherein the fuel injectors inject in a direction perpendicular to the valved openings.

97. A reed type valve arrangement as set forth in claim 95 wherein the fuel injectors inject in a direction parallel to the valved openings.

98. A reed type valve arrangement as set forth in claim 94 wherein a single fuel injector injects fuel into both of the flow passage sections.

99. A reed type valve arrangement for a reciprocating machine having a passage serving a variable volume chamber of said machine, a mounting plate adapted to be affixed within said passage and having a flow passage extending therethrough, a first caging member formed integrally with said mounting plate and dividing said flow passage into a first portion terminating in a first valved opening and a second portion, a second caging member detachably affixed to said first caging member and in registry with said second portion of said flow passage, said second caging member forming a second valved opening in communication with said second portion of said flow passage, at least one of said caging members defining a third valved opening communicating with the respective portion of said flow passage, and means for affixing first, second and third reed valve elements across said first, second and third valved openings, respectively, for controlling the flow therethrough, said mounting plate having a flange portion that defines said flow passage and wherein said second caging member has a flange portion co-extension with said flange portion of said mounting plate and held in abutting relationship with said flange portion of said mounting plate.

100. A reed type valve arrangement as set forth in claim 99 wherein the flange portions of the mounting plate and the second caging member are held in abutting relationship with each other through their connection with the reciprocating machine.

* * * * *

UNITED STATES PATENT AND TRADEMARK OFFICE

CERTIFICATE OF CORRECTION

PATENT NO. : 5,823,150
DATED : October 20, 1998
INVENTOR(S) : Tsugunori Konakawa It is certified that error appears in the above-identified patent and that said Letters Patent is hereby corrected as shown below:

Column 20,
Line 24, "caring members" should be -- caging members --

Signed and Sealed this

Twenty-sixth Day of August, 2003

JAMES E. ROGAN
*Director of the United States Patent and Trademark Office*